US006418866B1

(12) United States Patent
Shimizu et al.

(10) Patent No.: US 6,418,866 B1
(45) Date of Patent: Jul. 16, 2002

(54) OPERATING METHOD OF FLUIDIZED-BED INCINERATOR AND THE INCINERATOR

(75) Inventors: Yoshihito Shimizu; Hiroki Honda; Masao Takuma; Toshihisa Goda; Shiro Sasatani, all of Yokohama (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/485,728

(22) PCT Filed: Jun. 15, 1999

(86) PCT No.: PCT/JP99/03163

§ 371 (c)(1),
(2), (4) Date: Apr. 25, 2000

(87) PCT Pub. No.: WO99/66264

PCT Pub. Date: Dec. 23, 1999

(30) Foreign Application Priority Data

| | | |
|---|---|---|
| Jun. 16, 1998 | (JP) | 10-168927 |
| Jun. 16, 1998 | (JP) | 10-168928 |
| Jun. 26, 1998 | (JP) | 10-181129 |
| Jun. 26, 1998 | (JP) | 10-181130 |
| Jun. 26, 1998 | (JP) | 10-181131 |

(51) Int. Cl.[7] ..... F23N 5/02; F23G 5/30

(52) U.S. Cl. ..... 110/347; 110/188; 110/190; 110/243; 110/244; 110/245

(58) Field of Search ..... 110/243, 244, 110/245, 347, 188, 190

(56) References Cited

U.S. PATENT DOCUMENTS

| | | | | |
|---|---|---|---|---|
| 3,863,577 A | * | 2/1975 | Steever et al. | 110/8 R |
| 4,084,545 A | | 4/1978 | Nack | |
| 4,111,158 A | | 9/1978 | Reh | |
| 4,154,581 A | | 5/1979 | Nack | |
| 4,593,630 A | * | 6/1986 | Tegen | 110/245 |
| 4,836,116 A | * | 6/1989 | Mackay et al. | 110/245 |
| 4,934,282 A | * | 6/1990 | Asai et al. | 110/244 |
| 4,960,057 A | * | 10/1990 | Oshita et al. | 110/345 |
| 4,962,711 A | * | 10/1990 | Yamauchi et al. | 110/347 |
| 4,993,332 A | * | 2/1991 | Boross et al. | 110/347 |
| 5,003,931 A | * | 4/1991 | Huschauer | 122/4 D |
| 5,005,528 A | * | 4/1991 | Virr | 122/4 D |

(List continued on next page.)

FOREIGN PATENT DOCUMENTS

| | | |
|---|---|---|
| GB | 1510946 | 7/1976 |
| JP | 59-13644 | 3/1984 |
| JP | 60-21769 | 5/1985 |
| JP | 63-2651 | 1/1988 |
| WO | WO 85/00119 | 1/1985 |

*Primary Examiner*—Ira S. Lazarus
*Assistant Examiner*—K. B. Rinehart
(74) *Attorney, Agent, or Firm*—Crowell & Moring LLP

(57) ABSTRACT

The objective of the present invention is to provide a fluidized bed incinerator which will increase the thermal capacity of the freeboard to respond to fluctuations of the load imposed by waste matter such as sludge or garbage with a high moisture content; which would absorb local and momentary temperature spikes due to load fluctuations or variations in the characteristics of the waste material. This invention comprises the steps of 1) injecting the primary air for fluidizing the fluidizing medium from a bottom of the fluidizing region; 2) injecting the secondary air into the splash region in which the bubbles on the surface of the fluidized sand blast and the particles are propelling upward when the bubbles are burst; 3) entraining and conveying upward the fluidizing medium to out of said incinerator via the freeboard; 3) recirculating the fluidizing medium to the fluidizing region; and 4) controlling the thermal capacity of the freeboard, and the temperature of the fluidizing medium to be constant by controlling the ration of the primary and secondary air.

8 Claims, 18 Drawing Sheets

U.S. PATENT DOCUMENTS 5,020,451 A * 6/1991 Maebo et al. ..... 110/189
5,044,287 A * 9/1991 Furukawa et al. ..... 110/346
5,078,100 A * 1/1992 Huschauer et al. ..... 122/4 D
5,105,748 A * 4/1992 Harada et al. ..... 110/346
5,363,812 A * 11/1994 Belin et al. ..... 122/4 D
5,665,319 A * 9/1997 Hirama et al. ..... 422/177
5,682,828 A * 11/1997 Phalen et al. ..... 110/245
5,829,368 A * 11/1998 Cote et al. ..... 110/342
5,967,098 A * 10/1999 Tanca et al. ..... 122/4 D

* cited by examiner

A : Initial load: Large

B : Initial load: Medium

C : Initial load: Small

OPERATING METHOD OF FLUIDIZED-BED INCINERATOR AND THE INCINERATOR

TECHNICAL FIELD

This invention concerns a method to operate a fluidized bed incinerator which incinerates waste containing solid carbon, such as sewage sludge, municipal garbage or industrial waste, and the incinerator employing this method. More specifically, it concerns a method to operate a fluidized bed incinerator which incinerates waste with a high moisture content, such as sewage sludge, and the incinerator employing this method.

TECHNICAL BACKGROUND

Fluidized bed incinerators can be divided into two types: those using fluidized beds of air bubbles, which are commonly employed to incinerate garbage and evaporated sewage sludge, and those using circulating fluidized beds, which are commonly employed in coal-burning boilers which generate electrical power and incinerators which burn a mixture of waste and fuel.

Fluidized bed incinerators employing air bubbles work as follows. When the velocity of the gas exceeds the speed at which the particles comprising the medium of flow become a fluid, air bubbles begin to form on the floor of the fluidized bed. These bubbles agitate the medium of flow, causing the interior of the bed to achieve an ebullient state, in which the fuel is combusted.

In circulating fluidized bed incinerators, the velocity of the aforesaid gas is forced to exceed the terminal velocity of the particles comprising the medium of flow. As the gas and the particles are vigorously mixed, the particles are entrained on the gas and dispersed and combusted above the fluidized bed. The dispersed particles are collected by a separating device such as a cyclone and recirculated in the incinerator.

These two types of fluidized bed incinerators account for most of the incinerators in use. Both are suitable for combusting low-quality fuel or waste. Most sewage sludge is processed in a fluidized bed incinerator, and municipal garbage and industrial waste tend to be burned in an incinerator connected in series with a stoker.

The configuration of the aforesaid air bubble-type fluidized bed incinerator is shown in FIG. 18. The bottom of a vertical cylindrical tower is filled with a quantity of sand 50*a*, the fluidizing medium. This sand forms bed region 50 (the bubbling region or the dense region). A fluidizing gas is injected through air inlet 53 and thereafter forced uniformly through dispersion devices 52, dispersion tubes feeding into the bottom of the bed. The velocity of the gas, which is the flow velocity at which the said gas is injected, is increased until it exceeds the speed at which the aforesaid fluidizing medium becomes a fluid. Air bubbles 50*b* form in the aforesaid fluidizing medium, agitating and fluidizing it, and causing its surface to assume an ebullient state.

The sludge to be incinerated is loaded into the furnace via sludge inlet 55, which is above the aforesaid bed region 50, now in an ebullient state. At the same time, an accelerant is loaded via inlet 54 and combusted. After the solid component of the sludge is combusted in bed region 50, its volatile component is combusted in freeboard 56, the space above bed region 50. The exhaust gas from the said combustion is released through exhaust vent 57 on the top of the tower.

In an air bubble-type fluidized bed incinerator, waste such as raw garbage or sludge is combusted through the following process.

1) The air used to create a fluid is injected via gas dispersion devices 52 at the start of combustion. The sand is heated by a burner from the top layer down. As its temperature rises, the bed is fluidized by air bubbles.

2) Next, the garbage to be incinerated is loaded into the chamber. If the heat value of the garbage is too low, an accelerant is introduced to maintain the interior of the bed at the proper temperature.

3) After combustion has begun, the air heated by the exhaust gas is used as the aforesaid fluidizing gas. The garbage in the chamber is vigorously mixed and fluidized with the heated sand in the bed region. After a short time, part of it is gasified by dry distillation, and the remaining solids are combusted.

4) The uncombusted gases and the volatile or light portions of the garbage are conducted to freeboard 56, the area above the fluidized bed, and there combusted.

When sewage sludge is incinerated in the aforesaid air bubble-type fluidized bed incinerator, the rate of combustion in the furnace is 60 to 80% in the fluidized bed, but it climbs to nearly 100% in the area of the freeboard.

Thus the combustion load of freeboard 56 is 20 to 40%, and the temperature of the freeboard is approximately 150° C. higher than that of the fluidized bed. Since the combustion energy required to incinerate raw garbage or sludge is likely to vary, parts of the freeboard may become too hot.

In an air bubble-type fluidized bed incinerator, the air heated by the exhaust gases to approximately 650° C. is reused in order to conserve energy and minimize pollution. To prevent harmful exhaust, the temperature at the vent of the incinerator must be regulated so that the average temperature of the uncombusted gases (mainly CO, dioxin and cyanogen) is around 850° C.

In order to maintain the sand bed fluidized by the medium at an appropriate average temperature, say between 700, and 750° C., the moisture load at the floor of the furnace must be less than 250 to 280 $kg/m^2h$. Because of the limitations of the equipment, the aforesaid velocity of the gas must be at least 0.5 m/s (to maintain stable bubbling, it must be 0.5 to 1.5 m/s). Thus to incinerate waste with a high water content, such as sewage sludge, the floor of the furnace is made larger than is necessary for combustion, and more air is supplied than is actually needed for combustion. More exhaust gas is produced, and the extra air is wasted.

In many cases, the relative density of the substance to be incinerated is equal to or less than that of the fluidized bed. If the substance is less dense than the bed, when it is loaded into the chamber via the freeboard it will float on the surface of the fluidized sand on the very top of bubbling region, and the temperature within that region will not be conducive to effective combustion.

Sewage sludge has a relative density of approximately 0.8 $t/m^3$. When it is loaded into the furnace, however, its moisture component immediately evaporates, leaving it with a density of 0.3 to 0.6 $t/m^3$. Assuming silica with a relative density of 1.5 $t/m^3$ is used as the fluidizing medium, it will attain a relative density of 1.0 $t/m^3$ also assuming that the bed expands by a factor of 1.5.

In a case like this, where the substance to be incinerated is relatively light, it will float on the surface of the sand in the bubbling region even if it is loaded from the freeboard. The combustion of the substance will be limited to the top layer and will not extend to the interior of the bed. This imposes limitations on the maximum load which are not present when combustion can be extended effectively to the entire lower portion of the bed, including the bubbling region in the lower half of the air bubble bed and the dense layer below it.

Moreover, if combustion is achieved only in the upper portion of the aforesaid sand bed, the volatile component of the substance to be burned will be propelled through the splash region above the bed and combusted in the freeboard. There will be more combustion in the freeboard, which has a low thermal capacity, and less in the region which contains the dense layer of sand with its high thermal capacity. As a result, the temperature in the furnace will be unstable.

Another problem which can occur is that the waste product which falls onto the sand on top of the aforesaid bubbling region may not break up effectively. This results in some portions remaining uncombusted and leads to improper fluidization.

Also, waste matter like raw garbage and sewage sludge contains a high volume of volatile components. Since these sublimate, they are combusted in the freeboard. This causes the temperature of the exhaust gases to be too high.

In particular, if the temperature of the sand in the fluidized bed drops below 750° C., the combustion rate in the bed will decrease, increasing the prospect of unstable combustion. Thus the temperature of the sand must be kept at 750° C. or higher. When the volatile component is combusted in the aforesaid freeboard, it cannot contribute to maintaining the temperature of the sand. This necessitates the addition of a great deal of accelerant.

As we have noted, prior art air bubble-type fluidized bed incinerators experience problems due to the differing fuel quality of different waste substances. If the waste contains a high proportion of volatile components, the temperature will spike in the freeboard. If the waste contains a great deal of moisture, the temperature of the sand will drop. There was no effective way to address these problems in the prior art.

In addition, prior art techniques could not mitigate the problem of temperature fluctuation in the freeboard caused by varying fuel quality in different parts of the waste material.

Since the temperature of the sand was likely to drop when a waste substance with a high moisture content like sludge was combusted in the fluidized bed, an accelerant was used to maintain a high temperature. However, since some or in some cases almost all of the accelerant would immediately sublimate, it would combust in the freeboard without contributing to the temperature of the sand. The accelerant was thus combusted to no purpose, which had a deleterious effect on the fuel cost.

To solve the aforesaid problems associated with air bubble-type fluidized bed incinerators, the present applicants investigated how to mitigate the overheating of the freeboard and how to elevate the density of the suspension in the freeboard so as to maintain it at a high thermal capacity in order to prevent load fluctuations, particularly those due to the varying quality of the substance to be burned. We also studied ways to circulate the heat from the combustion in the aforesaid freeboard into the region of the fluidized bed. In the course of these investigations, we developed the following techniques.

In the following section we shall discuss the techniques we developed, following the order of our investigations.

To recirculate the heat from the combustion in the aforesaid freeboard back to the fluidized bed, we might consider the use of a circulating fluidized bed. But a circulating bed lacks a distinct dense layer (dense bed) in its lower portion, so its capacity to absorb load fluctuations is negligible, and the characteristics of the exhaust gases are likely to be unstable.

One approach resulting in a fluidized bed incinerator with a distinct dense layer and which employs a method to entrain and recirculate the fluidizing medium is to use a medium which consists of particles of both a finer and a coarser grain. The finer particles form an entraining fluidized bed, and the coarser particles form a heavy fluidized bed. By combining the two sorts of beds, one achieves a furnace which can control the combustion of pulverized coal. The design of such a furnace is disclosed in Japanese Patent Publication (Koukoku) 60-21769.

Overlaying an entraining fluidized bed of fine particles on a dense fluidized bed of coarser particles creates a high-density bed with two distinct temperature regions in its upper and lower halves. The design for a furnace using such a bed, which entails both combusting and gasifying high-sulfur coal, is disclosed in Japanese Patent Publication (Koukoku) 63-2651.

Both of the aforesaid approaches involve a fluidized bed consisting of an entraining bed made of fine particles which is superimposed on a heavy bed consisting of coarse particles. Since these coarse particles, the fluidizing medium in the heavy bed, experience significant abrasion, they must be replenished frequently, which complicates the maintenance of the furnace. Also, the use of the aforesaid coarse particles which are prone to abrasion results in a loss of stability due to variations of the particle size ratio.

The technique suggested in Japanese Patent Publication (Koukai) 4-54494 entails overlaying a bed of coarse particles on an entraining bed of recirculating fine particles to create a low-speed region on top of a high-speed region. The aforesaid low-speed region of coarse particles has two gas inlets to insure that it remains completely fluidized. The speed and efficiency of the reaction can be adjusted by increasing or decreasing the velocity of the fluidizing gas and the recirculation rate of the fine particles.

Just how much the capacity of the system can be increased in the ways described above is limited by the size of the fine and coarse particles and by how well the coarse particles can be fluidized, which depends largely on the aforesaid speed of fluidization. There is also a tendency for changes in the system to result in unstable reaction conditions.

Since the device disclosed in Japanese Patent Publication (Koukai) 4-54494 also entails overlaying a dense bed of coarse particles on an entraining bed of fine particles, it, like the two inventions previously discussed, suffers from extensive abrasion of the coarse particles which serve as the fluidizing medium in the heavy bed. Its maintenance is complicated by the requirement that the coarse particles be replenished very frequently, and the use of coarse particles which are prone to abrasion results in variation in the particle size ratio, which causes the system to be unstable. Furthermore, even the fact that the device has two gas inlets results in virtually no better control of the suspension density of the fine particles in the entraining bed.

The following design has also been proposed for a fluidized bed incinerator and its drive method.

Japanese Utility Model Publication (Koukai) 61-84301 offers a design for a fluidized bed incinerator which has heat transfer pipes in the bed to conserve and redistribute heat within the system. These pipes are arranged in the bed so that their axes are at an angle between 0 and 15° with respect to a perpendicular through the splash zone of the bed; in other words, they are virtually perpendicular.

The invention disclosed in Japanese Patent Publication (Koukai) 5-223230 comprises a fluidized bed combustion furnace in which a portion of the floor of the furnace, which portion is inclined at an angle of at least 10°, is perforated to form an air dispersion panel. The remainder of the bottom of the fluidized bed has air dispersion pipes in it. The fluidizing medium is poured onto these two portions of the floor, forming a fluidized bed with air dispersion tubes and an inclined fluidized bed with perforations to disperse the air, or a static bed. The fluidizing medium, as well as any uncombusted matter, is removed via pipe 17 on the floor of the furnace. Fluidizing medium of a specified particle size is recirculated and supplied to the inclined, perforated portion of the floor through an opening for that purpose. The garbage to be burned is also deposited on the inclined portion of the floor. A quantity of air which is from 0.7 to 1.5 times that of the minimum volume of gas required to fluidize the bed is supplied, and the garbage is gradually heated, disintegrated and combusted. A quantity of air which is from 2 to 9 times that of the minimum volume of fluidizing gas is supplied to the remaining char on the portion of the floor with the dispersion pipes, and it too is combusted. In this way, even if the quality of the fuel or the volume supplied should undergo a large momentary fluctuation, it will not result in incomplete combustion due to insufficient oxygen or the production of a large quantity of CO.

The invention disclosed in Japanese Patent Publication (Koukai)) 64-54104 comprises a fluidized bed combustion furnace. This furnace has a combustion tower in the bottom of which a layer of solid particles consisting of sand or ash is created and maintained; a mechanism in the middle of the layer of solid particles to inject a fluidizing gas in order to create a fluidized bed in the upper portion of the particle layer; a mechanism to cool the particles, which is placed in the static bed comprising the particle layer below the fluidized bed, and which cools the particles by means of heat exchange with water or air; a mechanism to recirculate the particles, which returns them to the fluidized bed via an exhaust port in the bottom of the tower; and a control mechanism, which controls the quantity of particles recirculated.

In the prior art designs disclosed in the aforesaid Japanese Utility Model Publication (Koukai) 61-84301, Japanese Patent Publications (Koukai) 5-23230 and 64-54104, there are no mechanisms to control precisely the ratio of primary and secondary air, to recirculate particles efficiently to the sand bed in order to absorb abnormal temperatures in the freeboard which are caused by load fluctuations or variation in the characteristics of the waste material, or to maintain the proper temperature in the sand bed.

Japanese Patent Publications (Koukoku) 59-13644 and 57-28046 offer designs which can be applied to this sort of fluidized bed incinerator and its operating method, but these, too, lack any means to address the problem areas described above.

DISCLOSURE OF THE INVENTION

To solve these problems, the first objective of the present invention was to provide a fluidized bed incinerator and an operating method for it which would increase the thermal capacity of the freeboard to respond to fluctuations of the load imposed by waste matter such as sludge or garbage with a high moisture content; which would absorb local and momentary temperature spikes due to load fluctuations or variations in the characteristics of the waste material; and which would recirculate the combustion heat generated in the freeboard and use it to maintain the temperature of the sand bed so as to reduce the need for accelerant.

The second objective of this invention was to provide a fluidized bed incinerator and an operating method for it which would enable the waste matter to be combusted in the deep portion of the fluidized bed. This portion extends as far as the bubbling region and the dense bed, which are below the surface of the bed of fluidized sand. In this way a greater quantity of waste material can be combusted in the sand bed, which has a higher thermal capacity than the freeboard.

Other objectives of this invention is disclosed in the following descriptions.

According to the invention disclosed in one embodiment, the fluidized bed incinerator has a splash region in which the particles of the fluidizing medium are propelled upward when the bubbles on the surface of the fluidized sand in the fluidizing region burst by injecting the primary air from the bottom of the fluidized bed for fluidizing the sand, and a freeboard region provided above the splash region, comprising: 1) an entraining region in which the particles are entrained and conveyed upward to the freeboard region by introducing the secondary air; 2) a recirculation unit to separate the particles of the fluidizing medium from the mixture of the exhaust gases and the fluidizing medium, and recirculate the fluidizing medium to the fluidizing region; and 3) an air control unit to adjust the ratio of the primary and secondary air based on the temperature difference between the freeboard region and the fluidizing region.

The air control unit preferably comprises a first damper to control the primary air to be introduced into the fluidizing region, and a second damper to control the secondary air to be introduced into the splash region, thereby said air control unit controls the ratio of the primary and secondary air.

The invention disclosed in another embodiment is an operating method to operate a fluidized bed incinerator. It comprises steps of: 1) injecting the primary air for fluidizing the fluidizing medium from a bottom of the fluidizing region; 2) injecting the secondary air into the splash region in which the bubbles on the surface of the fluidized sand burst and the particles are propelled upward when the bubbles are burst; 3) entraining and conveying the fluidizing medium upward and out of said incinerator via the freeboard; 4) recirculating the fluidizing medium to the fluidizing region; and 5) controlling the thermal capacity of the freeboard and the temperature of the fluidizing medium to be constant by controlling the ratio of the primary and secondary air.

The controlling step preferably controls the suspension density in the freeboard and the volume of recirculated fluidizing medium by controlling the ration of the primary and secondary air. The suspension density in the freeboard is preferably kept between 1.5 $kg/m^3$ and 10 $kg/m^3$.

With the invention described above, a splash zone, namely a space of discontinuous density resulting from the primary air tossing up particles of sand, is created between the freeboard in the upper part of the furnace and the bed region in the lower part of the furnace. In this invention, secondary air is brought into this splash zone. The particles of sand lifted into the splash zone on the primary air are entrained and conveyed into the freeboard along with the primary air. Increasing the quantity of particles held up in the region through which the sand travels increases the thermal capacity of the freeboard. In this way the system can respond to load fluctuations.

In this invention, the aforesaid particles which are entrained on the air (i.e., the particles tossed up by the primary air) are separated from the air by a cyclone or other separation means provided in a later stage of their travel. They are then sent back to the bed region by a recirculation unit provided downstream from the cyclone. This design allows the combustion heat from the freeboard to be applied to the cooler fluidizing medium in the bed region, thus helping maintain the temperature of the sand bed and reducing the need for auxiliary fuel for that purpose.

In other words, since it is necessary to keep the sand in the fluidizing region at a constant temperature, the fluidizing medium which has absorbed the combustion heat in the hotter freeboard is sent back to the cooler dense bed of the fluidizing region to supply heat to the sand of the bed. This insures that the exhaust gas is at the appropriate temperature, and it eliminates the need for extra fuel.

The thermal capacity of the aforesaid sand in the freeboard is a thousand times greater than that of a gas. It is thus well suited to mitigate temperature fluctuations in the freeboard caused by variations in the characteristics of the sludge which is being combusted. The use of this sand can eliminate inhomogeneous combustion due to load fluctuations and enable stable combustion to take place.

When a control unit adjusts the relative opening of two dampers, it adjusts the ratio of primary to secondary air in the fixed quantity of air supplied to the furnace. This controls the holdup rate of the sand used as the fluidizing medium in the area above the point at which the secondary air is admitted. The suspension density in the freeboard is adjusted so that it remains between 1.5 $kg/m^3$ and 10 $kg/m^3$. This insures that the thermal capacity of the freeboard can be increased or decreased as needed to respond to load fluctuations.

In this way, the quantity of primary air which serves as the fluidizing gas can be increased to expand the fluidized bed. The height of the sand surface and that of the splash zone, demarked by the highest point reached by a tossed particle of sand, can thus be increased by introducing more primary air. By increasing or decreasing the holdup rate of the fluidizing medium entrained by the secondary air above its inlet in the splash zone, we can adjust the suspension density of the freeboard through which the medium passes so that it is between 1.5 $kg/m^3$ and 10 $kg/m^3$.

This ability to maintain the temperature of the sand in the aforesaid bed region at its proper value enables us to design a furnace with a smaller floor area which can still handle the high moisture component of sludge. The sand can be fluidized with a smaller volume of air, and the volume of air beyond what is strictly necessary for combustion can be minimized. The furnace produces less exhaust gas, the quantity of auxiliary fuel can be reduced, and the fuel cost can be held down.

When the suspension density in the freeboard is excessive, or more specifically, when it exceeds the aforesaid range, the aforesaid control unit reduces the proportion of primary air and increases the proportion of secondary air going into the furnace. This reduces the quantity of medium thrown up from the bed region and so reduces the quantity of the said medium which is in circulation. Reducing the quantity of sand in circulation prevents abrasion of the device and reduces the cost of operating the blowers.

According to the invention disclosed in certain preferred embodiments, the fluidized bed incinerator has a splash region in which the particles of the fluidizing medium are propelled upward when the bubbles on the surface of the fluidized sand in the fluidizing region burst by injecting the primary air from the bottom of the fluidized bed for fluidizing the sand, and a freeboard region provided above the splash region, comprising: 1) an entraining region in which the particles are entrained and conveyed upward to the freeboard region by introducing the secondary air; and 2) a secondary air control means provided with an air supplying unit to supply the secondary air from one of a plurality of air inlets which are provided in the splash region vertically, said secondary air control means to control the open and close of said air supplying unit.

The invention disclosed above is preferably comprising as follows.

1) The fluidized bed incinerator further comprises: 1) a recirculation unit to separate the particles of the fluidizing medium from the mixture of the exhaust gases and the fluidizing medium, and recirculate the fluidizing medium to the fluidizing region; and 2) an air control unit to adjust the ratio of the primary and secondary air based on the temperature difference between the freeboard region and the fluidizing region.

2) The secondary air control means controls the open and close of the plurality of air inlets based on the temperature difference between the freeboard region and the fluidizing region.

The invention disclosed in certain preferred embodiments is related to the operating method to operate a fluidized bed incinerator. The method comprises steps of: 1) injecting the primary air for fluidizing the fluidizing medium from a bottom of the fluidizing region; 2) injecting the secondary air into the splash region in which the bubbles on the surface of the fluidized sand burst and the particles are propelled upward when the bubbles are burst, said secondary air being injected selectively from one or more air inlets provided vertically; 3) entraining and conveying the fluidizing medium upward and out of said incinerator via the freeboard; and 4) controlling the suspension density in the freeboard by selecting the air inlets for adjusting the height of said injecting the secondary air.

The following operation methods can be preferably added to the method disclosed above.

1) Recirculating the fluidizing medium via a recirculation unit provided out of the fluidized bed incinerator.

2) The controlling step controls the suspension density in the freeboard and the volume of recirculated fluidizing medium by controlling the ration of the primary and secondary air. The suspension density in the freeboard is preferably kept between 1.5 $kg/m^3$ and 10 $kg/m^3$.

With this invention, when the bubbles on the surface of the bubbling bed burst, some of the sand particles which constitute the fluidizing medium are tossed upward, forming a splash zone consisting of a layer of discontinuous density over the aforesaid bed region. A number of supply units for secondary air are provided at different heights in the splash zone, where particles of sand separated from the surface by air bubbles are floating about. Through one of these units, a control device for the secondary air selectively admits air at a given height. This creates an entraining region which extends as far as the freeboard above the splash zone. The particles of fluidizing medium are thus entrained and conveyed out of the furnace.

Since the freeboard, through which the particles of fluidizing medium are being entrained and conveyed, can hold up as many particles as reach it, this design greatly increases the suspension density in the freeboard as well as its thermal capacity. As a result, it is better able to respond to load fluctuations.

By admitting the aforesaid secondary air selectively through one of a number of supply units at different heights, we can adjust the suspension density in the freeboard above the point at which the air enters the furnace so that it remains between 1.5 kg/m$^3$ and 10 kg/m$^3$. More specifically, since the splash zone into which the supply units for the secondary air open is created when air bubbles on the bed surface burst, sending particles of sand flying up into the air, its density is highest immediately above the surface and decreases as the distance from the surface increases. Thus the density of the fluidizing medium entrained on the secondary air will be greater if the air is admitted closer to the surface. Admitting air through the lowest channel will yield the greatest suspension density in the freeboard.

Thus by selecting one of the various supply channels for secondary air which are provided at different heights in the furnace, we can adjust the suspension density of the sand particles carried to the freeboard by the secondary air. More specifically, by selecting an appropriate channel for the secondary air and an appropriate means to admit the air, we can adjust the suspension density in the freeboard so that it remains within its required range, between 1.5 kg/m$^3$ and 10 kg/m$^3$. This will allow the furnace to respond to sudden temperature spikes resulting from variations in the characteristics of the waste material.

With this invention, the particles of fluidizing medium (i.e., the particles thrown up by the air bubbles) entrained and conveyed as described above are separated from the air by a cyclone or other separator device placed downstream from the aforesaid entraining area. The particles pass through an external recirculation unit which includes the aforesaid separator device and are returned to the aforesaid bubbling region. In this way the combustion heat from the freeboard can be applied to the cooler fluidizing medium in the bubbling region so as to maintain the required temperature in the sand bed and thus reduce the need for auxiliary fuel for that purpose.

In other words, since it is necessary to keep the sand in the aforesaid fluidizing region at a constant temperature, the fluidizing medium which has absorbed the combustion heat in the hotter freeboard is sent back to the cooler dense bed of the fluidizing region to supply heat to the sand of the bed. This insures that the exhaust gas is at the appropriate temperature, and it eliminates the need for extra fuel.

The ratio of primary to secondary air determines what quantity of the aforesaid particles which are tossed up will be circulated. By adjusting this ratio, we can keep the temperature of the fluidizing region constant. By returning the fluidizing medium which has absorbed the combustion heat in the hotter freeboard to the cooler dense bed of the fluidizing region, we can supply heat to that region.

According to the invention disclosed in certain preferred embodiments, the fluidized bed incinerator comprises: 1) a splash region in which the particles of the fluidizing medium are propelled upward when the bubbles on the surface of the fluidized sand in the fluidizing region burst by injecting the primary air from the bottom of the fluidized bed for fluidizing the sand; 2) a freeboard region provided above the splash region; 3) an entraining region in which the particles are entrained and conveyed upward to the freeboard region by introducing the secondary air; 4) a recirculation unit to separate the particles of the fluidizing medium from the mixture of the exhaust gases and the fluidizing medium by a separation means, and recirculate the fluidizing medium to the fluidizing region; and the recirculation unit comprises: 4–1) a sealed pot provided under said separation means, said sealed pot comprising an accumulation region to accumulate the fluidizing medium separated by said separation means, and a pressurized region to recirculate the fluidizing medium into a connecting duct connected to the fluidizing region by the pressure of the recirculation air introduced from the bottom of said accumulation region; and 4–2) a recirculation control means to control the recirculation air in order to control the quantity of the fluidizing medium.

The fluidized bed incinerator preferably comprises an air control unit to adjust the ratio of the primary and secondary air based on the temperature difference between the freeboard region and the fluidizing region.

This invention comprises a fluidized bed incinerator for sewage sludge, municipal garbage, or other waste with a high moisture content. In this incinerator, the thermal capacity of the freeboard can be increased to respond to load fluctuations so that local or momentary temperature spikes due to load fluctuations can be absorbed. The combustion heat produced in the said freeboard is recirculated to help maintain the proper temperature in the sand bed, and the suspension density in the freeboard can be increased for the same purpose.

With this invention, then, primary air fluidizes a bed region and causes bubbles to form in it. When the bubbles on the surface of the bed burst, particles of sand are tossed upward to form a splash zone, a layer of discontinuous density over the aforesaid bed region. When secondary air is blown into this splash zone, groups of particles separated from the surface by the bursting of bubbles are entrained on the secondary air and conveyed through the freeboard and out of the furnace. The suspension density in the freeboard is adjusted by changing the quantity of particles entrained by the secondary air, which is accomplished by altering the ratio of the aforesaid primary to secondary air. A control unit also adjusts the total volume of primary and secondary air supplied to the furnace. The suspension density is controlled by the following means. An appropriate quantity of the sand entrained by the aforesaid secondary air and stored temporarily in an external recirculation unit is recirculated to adjust the holdup rate of the sand bed in the bubbling region. This results in an adjustment of the suspension density in the freeboard.

To be more specific, with this invention, the volume of air blown into the bottom of the recirculation segment of the aforesaid sealed pot is adjusted in order to cause the sand bed consisting of sand collected in the said recirculation segment to expand. The topmost layer of the expanded bed will overflow out of the sealed pot and return to the sand bed in the bubbling region. This will increase the holdup rate in the bubbling region, and as a result the holdup rate in the freeboard will also increase, resulting in a greater suspension density.

The control unit controls the ratio of primary to secondary air. By controlling this ratio, we can control the holdup rates in the bed region and the freeboard, which are in an inverse relation with each other, and the suspension density and quantity of particles in circulation in response to fluctuations of the combustion characteristics of the material to be incinerated.

If, for example, we increase the proportion of primary air, we will increase the quantity of particles tossed up from the bed region. This will increase the holdup rate in the space above the inlet for the secondary air. It will also increase the suspension density in the freeboard and the quantity of particles in circulation.

According to the invention disclosed in certain preferred embodiments, the fluidized bed incinerator comprises: 1) a splash region in which the particles of the fluidizing medium are propelled upward when the bubbles on the surface of the fluidized sand in the fluidizing region burst by injecting the primary air from the bottom of the fluidized bed for fluidizing the sand; 2) a freeboard region provided above the splash region; 3) an entraining region in which the particles are entrained and conveyed upward to the freeboard region by introducing the secondary air; 4) a recirculation unit to separate the particles of the fluidizing medium from the mixture of the exhaust gases and the fluidizing medium and recirculate the fluidizing medium to the fluidizing region; 5) a buffer tank to store the fluidizing medium discharged from an outlet along with uncombusted material, which is provided below the fluidizing region; and 6) a buffer tank control means to control the supplying the fluidizing medium to the fluidizing region based on the temperature in said freeboard region depending on the load fluctuation in said fluidized bed incinerator.

According to the invention disclosed in certain preferred embodiments, the fluidized bed incinerator comprises: 1) a splash region in which the particles of the fluidizing medium are propelled upward when the bubbles on the surface of the fluidized sand in the fluidizing region burst by injecting the primary air from the bottom of the fluidized bed for fluidizing the sand; 2) a freeboard region provided above the splash region; 3) an entraining region in which the particles are entrained and conveyed upward to the freeboard region by introducing the secondary air; 4) a recirculation unit to separate the particles of the fluidizing medium from the mixture of the exhaust gases and the fluidizing medium and recirculate the fluidizing medium to the fluidizing region; 5) a buffer tank to store the fluidizing medium discharged from an outlet along with uncombusted material, which is provided below the fluidizing region; 6) an air control unit to adjust the ratio of the primary and secondary air based on the load fluctuation in said fluidized bed incinerator; and 7) a buffer tank control means to control the supplying the fluidizing medium to the fluidizing region based on the load fluctuation.

The air control unit disclosed preferably controls as follows.

1) It adjusts the ratio of the primary and secondary air based on the temperature difference between the freeboard region and the fluidizing region, and said buffer tank control means controls the quantity of the fluidizing medium for providing to the fluidizing region based on the temperature at a predetermined location in said fluidized bed incinerator.

2) It adjusts the ratio of the primary and secondary air so that the sum of the quantities of primary air and secondary air remains constant.

With this invention, primary air fluidizes a bed region and causes bubbles to form in it. When the bubbles on the surface of the bed burst, particles of sand are tossed upward to form a splash zone, a layer of discontinuous density over the aforesaid bed region. When secondary air is blown into this splash zone, groups of particles separated from the surface by the bursting of bubbles are entrained on the secondary air and conveyed through the freeboard and out of the furnace. The suspension density in the freeboard is adjusted by changing the quantity of particles entrained by the secondary air, which is accomplished by altering the ratio of the aforesaid primary to secondary air. More specifically, the suspension density is adjusted to remain between 1.5 kg/m$^3$ and 10 kg/m3. The fluidizing medium which has been discharged from the furnace via the outlet on the bottom of the fluidized bed is stored in a buffer tank. In order to achieve a wide range of suspension densities, these sand particles are supplied to the furnace as needed to respond to the state of the load. This constitutes an internal recirculation unit for the sand which allows the suspension density in the freeboard and the quantity of particles in circulation to be adjusted over a wide range of values.

To be more specific, the fluidizing medium is passed through a vibrating sieve or other separation device on the outlet for uncombusted material on the bottom of the fluidized bed. The filtered fluidizing material is collected in a buffer tank. In response to the state of combustion in the freeboard, an appropriate quantity of medium is supplied to the combustion chamber of the furnace, i.e., to the freeboard. In this way the holdup rate in the freeboard is adjusted and the suspension density and the quantity of particles in circulation is increased. A wide range of responses is thus available for load fluctuations.

With this invention, because the sand is kept circulating through the freeboard so that its thermal capacity is available to absorb temperature fluctuations which occur there, the temperature in the furnace can be kept constant despite load fluctuations, and the furnace can operate in a stable fashion. Because the hotter medium is returned to the dense bed, the sand in the bed can be kept at the required temperature, and the load consisting of moisture content on the floor of the furnace can be increased. This invention reduces the quantity of exhaust gas and the required fuel cost, and it insures that the exhaust gas will be at the required temperature.

Because the ratio of primary to secondary air is controlled, the holdup rates in the bed region and the freeboard, which are in an inverse relation with each other, can be adjusted in response to variations in the combustion characteristics of the material to be incinerated. To be more specific, the suspension density is kept between 1.5 kg/m$^3$ and 10 kg/m$^3$.

According to the invention disclosed in certain preferred embodiments, the fluidized bed incinerator comprises: 1) a bubble fluidizing region having a dense region and a bubbling region above said dense region; 2) a splash region in which the particles of the fluidizing medium are propelled upward when the bubbles on the surface of the fluidized sand in said bubble fluidizing region burst by injecting the primary air from the bottom of the fluidized bed for fluidizing the sand; 3) a freeboard region provided above the splash region; 4) an entraining region in which the particles are entrained and conveyed upward to the freeboard region by introducing the secondary air; 5) a recirculation unit to separate the particles of the fluidizing medium from the mixture of the exhaust gases and the fluidizing medium and recirculate the fluidizing medium to said dense region; and 6) a waste inlet through which the waste material is loaded, which is to be incinerated in said bubble fluidizing region having said dense region and said bubbling region.

The fluidized bed incinerator above preferably comprises a fluidizing medium inlet for returning said fluidizing medium placed at the same height as said waste inlet or at the lower position than said waste inlet, and an auxiliary burner.

With this invention, the waste material is introduced into the dense bed in the region which is fluidized by blowing in air. Combustion occurs in the deep portion of the fluidized bed, including the said dense bed and the bubbling region on top of it. The material is thus combusted in the sand bed, which has a high thermal capacity. This insures that stable combustion can be maintained.

The waste material is introduced directly into the very hot fluidized bed below the vigorously fluidized bubbling region, whose surface remains in a boiling state. The waste is pulverized when it experiences the explosive force of momentary volatilization of its moisture component and distributed uniformly throughout the entire bubbling region above the bed. Thus even the dense bed on the bottom of the bed region can be used efficiently for combustion. This results in a wider range of permitted loads.

Because the waste material is supplied to a relatively deep portion of the fluidized bed, only a small proportion of its volatile component is lost to the freeboard. The greater portion is combusted in the sand bed, which has a higher thermal capacity. This design allows the furnace to absorb load fluctuations and maintain a stable temperature.

As was discussed above, the waste material which is introduced into the middle of the fluidized bed, in an area which is fluidized at a high temperature and under extreme pressure, experiences the tremendous force produced by instantaneous volatilization of its moisture component. This prevents the formation of clods of melted ash which would impede fluidity.

Placing the inlet for medium being returned from the external recirculation unit and the installation for the auxiliary burner at the same level or lower than the inlet for the aforesaid waste material prevents the temperature of the fluidized bed from dropping when waste is loaded into the aforesaid dense bed.

CAPTIONS

011: fluidized bed incinerator, 100: Recirculation unit, 101: Ratio control unit, 10: Fluidizing region, 10*d*: Fluidized sand, 12: Entraining area, 12*b*: Splash region, 12*d*: Dense bed, 13: Freeboard region, 14: Separator, 15: Sealed pot, 15*a*: Region of sealed pot, 15*b*: Pressurized region, 15*c*: duct, 16: Inlet for waste material, 17: Gas supply system, 17*a*, 17*b*: blowers, 18: Primary air, 18*c*: Distribution device, 19: Secondary air, 18*b*, 19*b*: Dampers, 20, 21: Air channels, 22, 23, 24: Channels, 22*a*, 23*a*, 24*a*: Inlets for the secondary air, 22*b*, 23*b*, 24*b*: Dampers, 28: Buffer tank, 30: Control unit

PREFERRED EMBODIMENTS OF THE INVENTION

In this section we shall give a detailed explanation of the invention with reference to the drawings, using preferred embodiments for the purpose of illustration. To the extent that the dimensions, materials, shape and relative position of the components described in these embodiments need not be definitely fixed, the scope of the invention is not limited to the embodiments as described herein, which are meant to serve merely as examples.

First Preferred Embodiment

Figure 1:
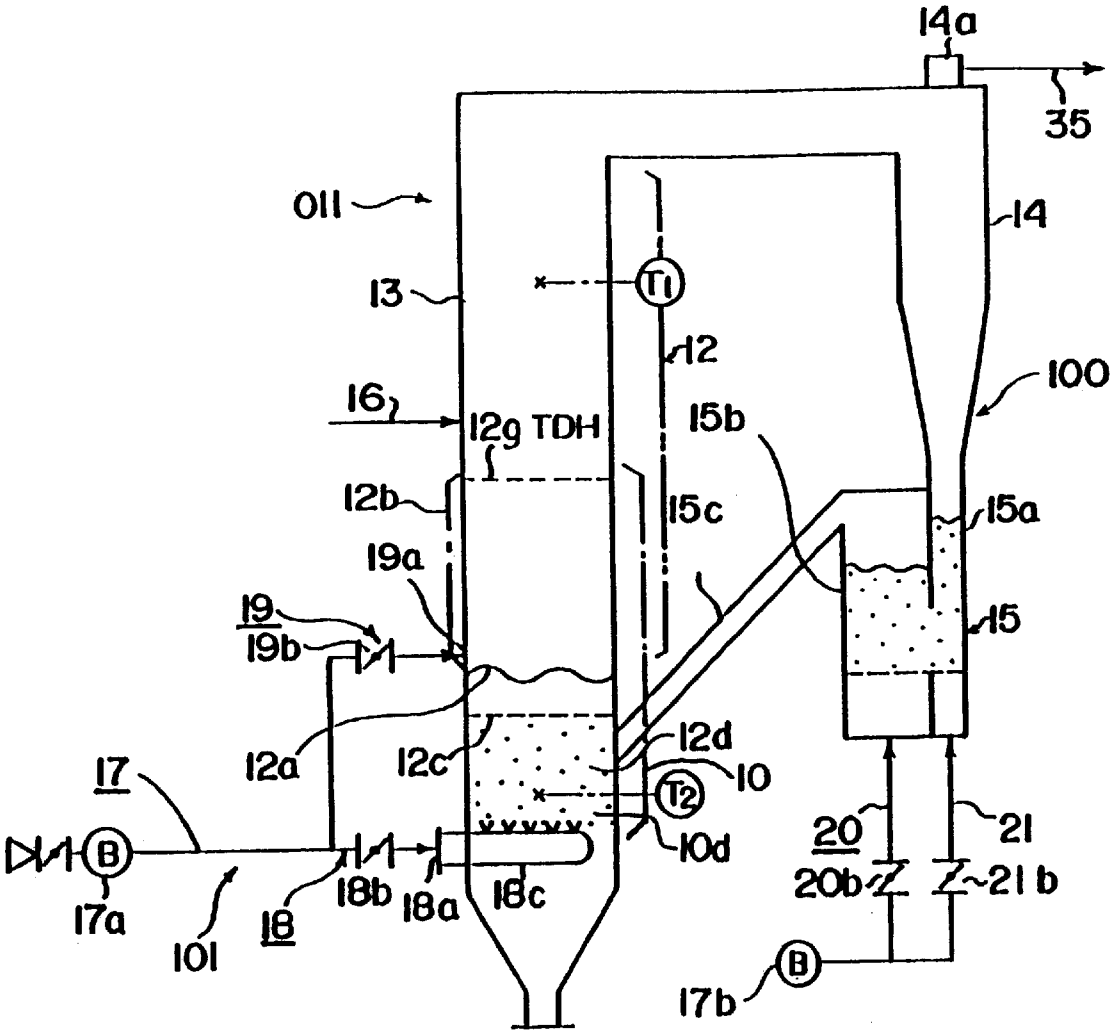
FIG. 1 illustrates the rough sketch of the fluidized bed incinerator according to the first preferred embodiment of this invention.

In FIG. 1, 011 is a fluidized bed incinerator. In the first embodiment, it is constructed as follows.

10 is the region in the lowest part of the tower which contains sand fluidized by air bubbles. Primary air 18 is injected into the bottom of this region via device 18*c* to disperse the fluidizing gas. Fluidizing sand 10*d*, the silica or other sand which serves as the fluidizing medium, is fluidized when air bubbles form in dense bed 12*d*.

12 is the region above the fluidizing region 10 in which the particles are entrained. When the bubbles on the surface 12*a* of the fluidized sand in the region 10 burst, particles are propelled upward into splash zone 12*b*. Secondary air 19 is introduced into splash zone 12*b* via aperture 19*a*, and the particles are entrained and conveyed upward into freeboard 13.

100 is the recirculation unit connected to the outlet of the aforesaid entraining region 12. The fluidizing medium which is driven up into splash zone 12*b* by the aforesaid secondary air 19 is entrained and conveyed through freeboard 13 and out of the furnace. It travels through separator 14, a cyclone or the like to separate the sand or other medium from the exhaust gases, then through sealed pot 15 and duct 15*c*, and is recirculated to the aforesaid fluidizing region 10.

101 is a control unit consisting of gas supply system 17 and dampers 18*b* and 19*b*. It adjusts the ratio of the aforesaid primary and secondary air.

Air channels 20 and 21 are connected to the bottom of the aforesaid sealed pot 15. Air channel 20 has a damper 20*b* and air channel 21 a damper 21*b* to open and close it.

The aforesaid gas supply system 17, which comprises control unit 101, employs blower 17*a* to send a fixed quantity of air (primary air 18+secondary air 19) through dampers 18*b* and 19*b*. This unit controls the ratio of primary and secondary air which it forces through inlets 18*a* and 19*a*.

The primary air 18 controlled by the aforesaid damper 18*b* is injected into the lower portion of the tower through inlet 18*a* and distributed by dispersion device 18*c*. The sand 10*d* in the aforesaid fluidizing region 10 begins to be fluidized at the initial fluidizing velocity, and it creates splash zone 12*b* and bed surface 12*a*.

In incinerator 011, the action of damper 18*b* in the aforesaid gas supply system 17 can be controlled to increase the velocity of the aforesaid primary air 18 in the tower. When this velocity exceeds the fluidizing threshold, bubbles form in fluidizing region 10. The said bubbles agitate the interior of the mass of sand, forming a non-uniformly fluidized bed. At the same time, fluidized sand 10*d* is launched upward from surface 12*a* of fluidized bed 10 to create the aforesaid splash zone 12*b*.

The aforesaid splash zone 12*b* has an inlet 19*a* for the aforesaid secondary air. This inlet creates a space of discontinuous density with respect to the bed surface 12*a* below it. Inlet 16, through which the substance to be incinerated (carbon) is loaded, is an appropriate distance above the aforesaid bed surface 12*a*.

Exhaust gas vent 14*a* is on the top of the aforesaid separator 14, a cyclone or the like. Through it, the exhaust gas 35 from which the entrained sand 10*d* has been separated is released to the exterior.

In a combustion furnace of this sort, the sand 10*d* which is separated from the surface of the bed by air bubbles and suspended in the atmosphere is entrained on the secondary air 19 introduced via inlet 19*a*. It is conveyed into freeboard 13 and eventually reaches separator 14, a cyclone or other device located downstream from the said freeboard 13. Once the sand has been separated from it, gas 35 is exhausted via vent 14*a* on the top of the separator. The sand 10*d* separated from the gas by the aforesaid separator 14 accumulates in region 15*a* of sealed pot 15, which is below the separator.

In the aforesaid sealed pot 15, the air supplied by channels 21 and 22 on the bottom of the pot causes sand 10*d* to collect in region 15*a*, while the sand 10*d* which has accumulated in pressurized region 15*b* is recirculated to dense bed 12*d* in fluidizing region 10.

When this sort of fluidized bed incinerator is in operation, dampers 18*b* and 19*b* of gas supply system 17 can be adjusted in such a way as to respond to variations in the fuel characteristics of the sludge or other substance to be burned and the quantity loaded. In this way the total quantity of primary air 18 and secondary air 19 can be controlled, and the quantity of sand 10*d* to be recirculated can be determined according to the characteristics of the waste material and the quantity loaded.

By adjusting the ratio of primary air 18 and secondary air 19, we can change the holdup and the density of the suspension of sand 10*d* in fluidizing region 10, splash region 12*b* and freeboard 13, and we can control the temperature of freeboard 13 and fluidizing region 10. For example, in order to achieve a suspension density between 1.5 $kg/m^3$ and 10 $kg/m^3$, the ratio of primary air 18 to secondary air 19 is set somewhere between 1 to 2 and 2 to 1.

Figure 2:
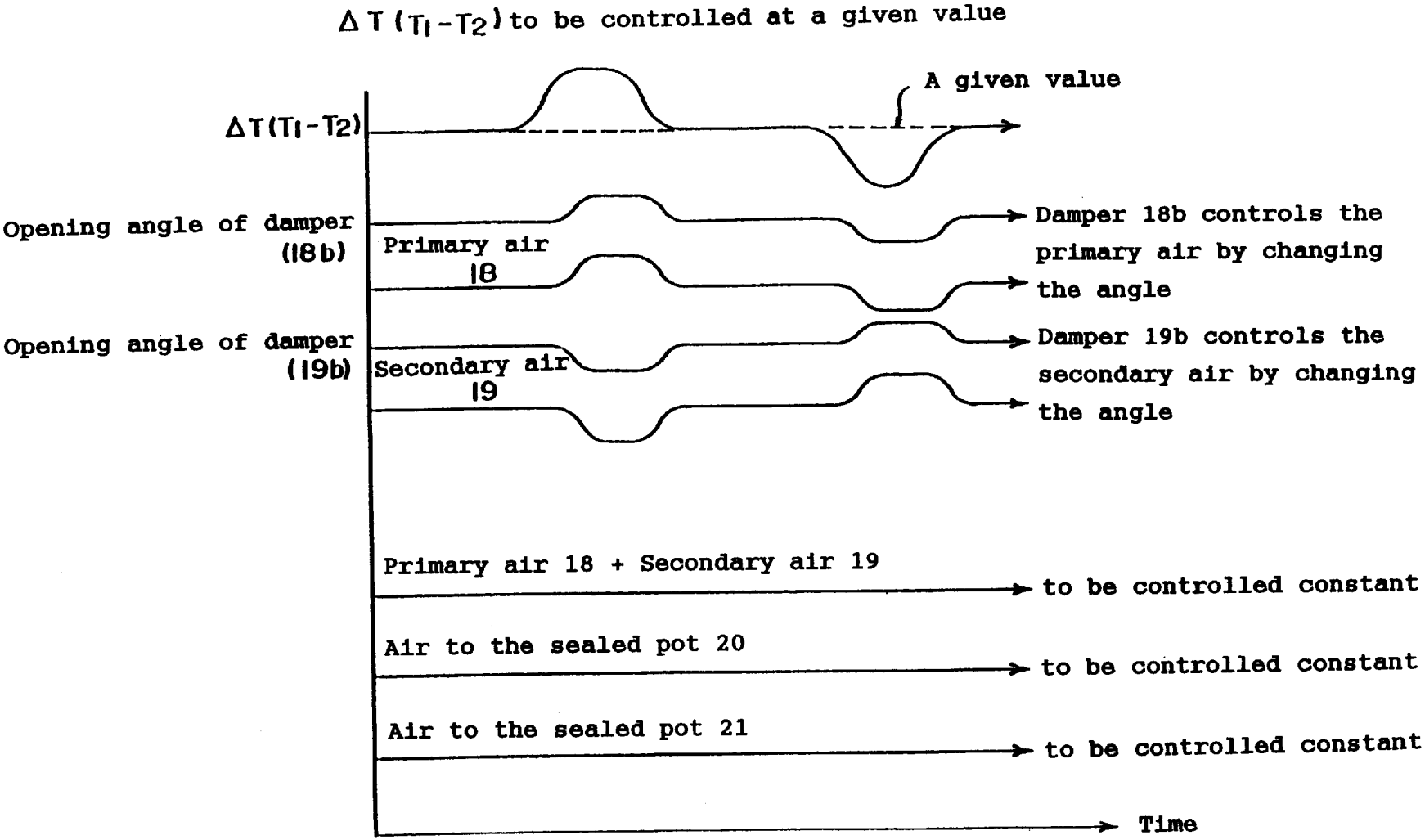
FIG. 2 illustrates the time chart of the first preferred embodiment.

The time chart shown in FIG. 2 shows how the ratio of primary air 18 to secondary air 19 is controlled in order to keep the difference between $T_1$, the temperature in freeboard 13 as measured by a thermometer in the said freeboard, and $T_2$, the temperature in fluidizing region 10 as measured by a thermometer in that region, at a given value. Monitoring these temperatures allows us to check whether the suspension density in freeboard 13 and the quantity of medium recirculated are being maintained at the proper values.

When the system is in operation, the ratio is controlled so that the sum of the quantities of primary air 18 and secondary air 19 remains constant, the quantity of sand 10*d* being recirculated remains constant, and the quantity of the aforesaid fluidizing air which is sent to sealed pot 15 remains constant.

In FIG. 1, the blower 17*b* which sends air to sealed pot 15 is a discrete device; however, it would also be acceptable for blower 17*a* to have a branching pipe going to the said sealed pot 15.

As can be seen in FIG. 2, when the difference $\Delta T\ (T_1-T_2)$ between the aforesaid temperatures $T_1$ and $T_2$ exceeds a given value, the damper 18*b* for primary air 18 is opened more and the damper 19*b* for secondary air 19 is closed more. This increases the proportion of primary air 18 and decreases the proportion of secondary air 19. The temperature $T_2$ of fluidizing region 10 increases, and the temperature $T_1$ of freeboard 13 decreases.

When the difference $\Delta T\ (T_1-T_2)$ between temperatures $T_1$ and $T_2$ falls below a given value, the damper 18*b* for primary air 18 is closed more and the damper 19*b* for secondary air 19 is opened more. This decreases the proportion of primary air 18 and increases the proportion of secondary air 19. The temperature $T_2$ of fluidizing region 10 decreases, and the temperature $T_1$ of freeboard 13 increases.

Second Preferred Embodiment

Figure 3:
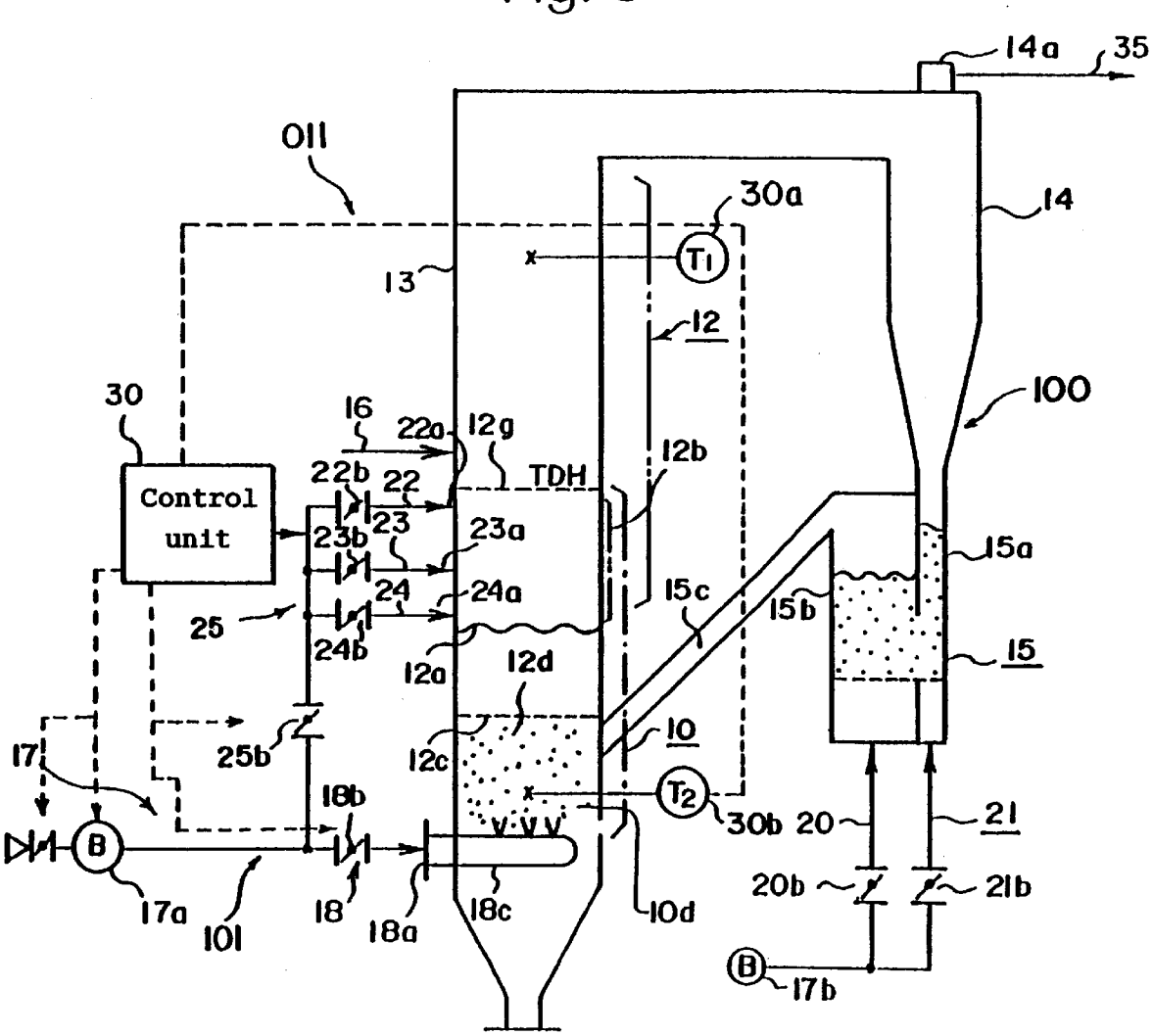
FIG. 3 illustrates the rough sketch of the fluidized bed incinerator according to the second preferred embodiment of this invention.
Figure 4:
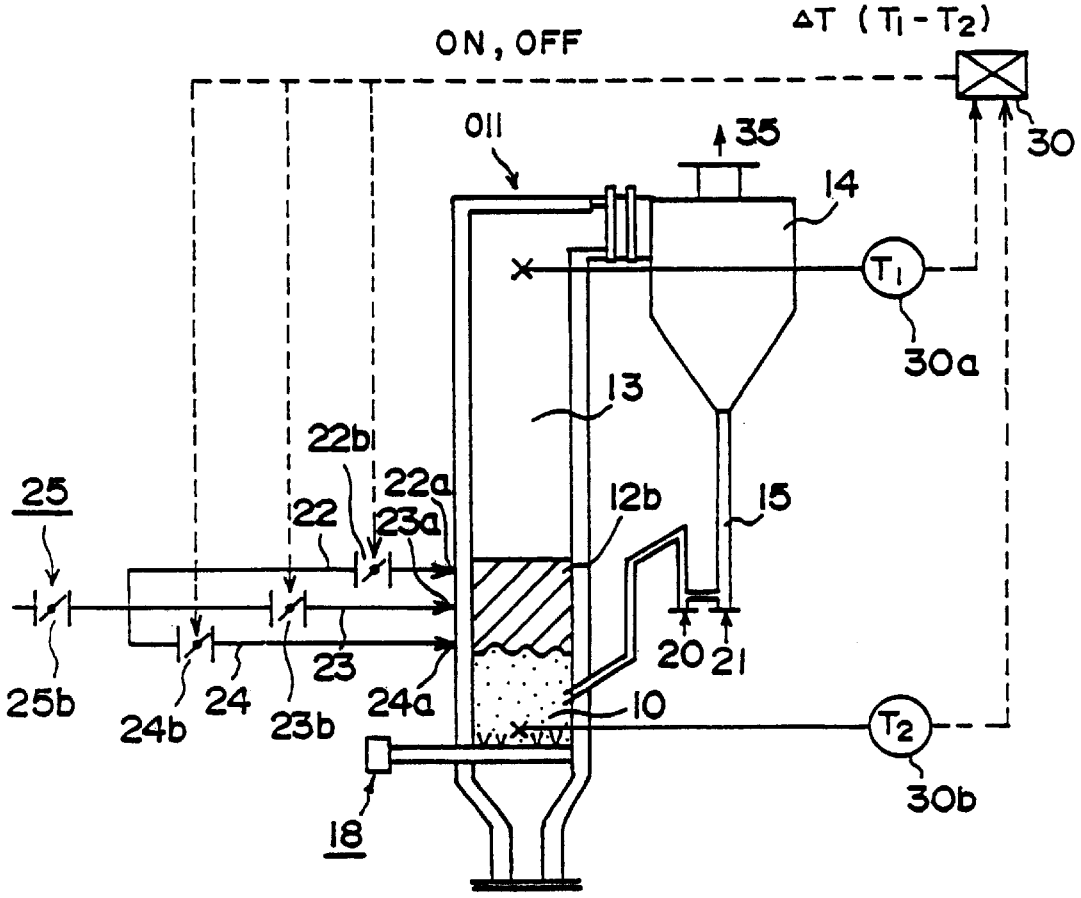
FIG. 4 illustrates the operational sketch of the fluidized bed incinerator according to the second preferred embodiment of this invention.
Figure 11:
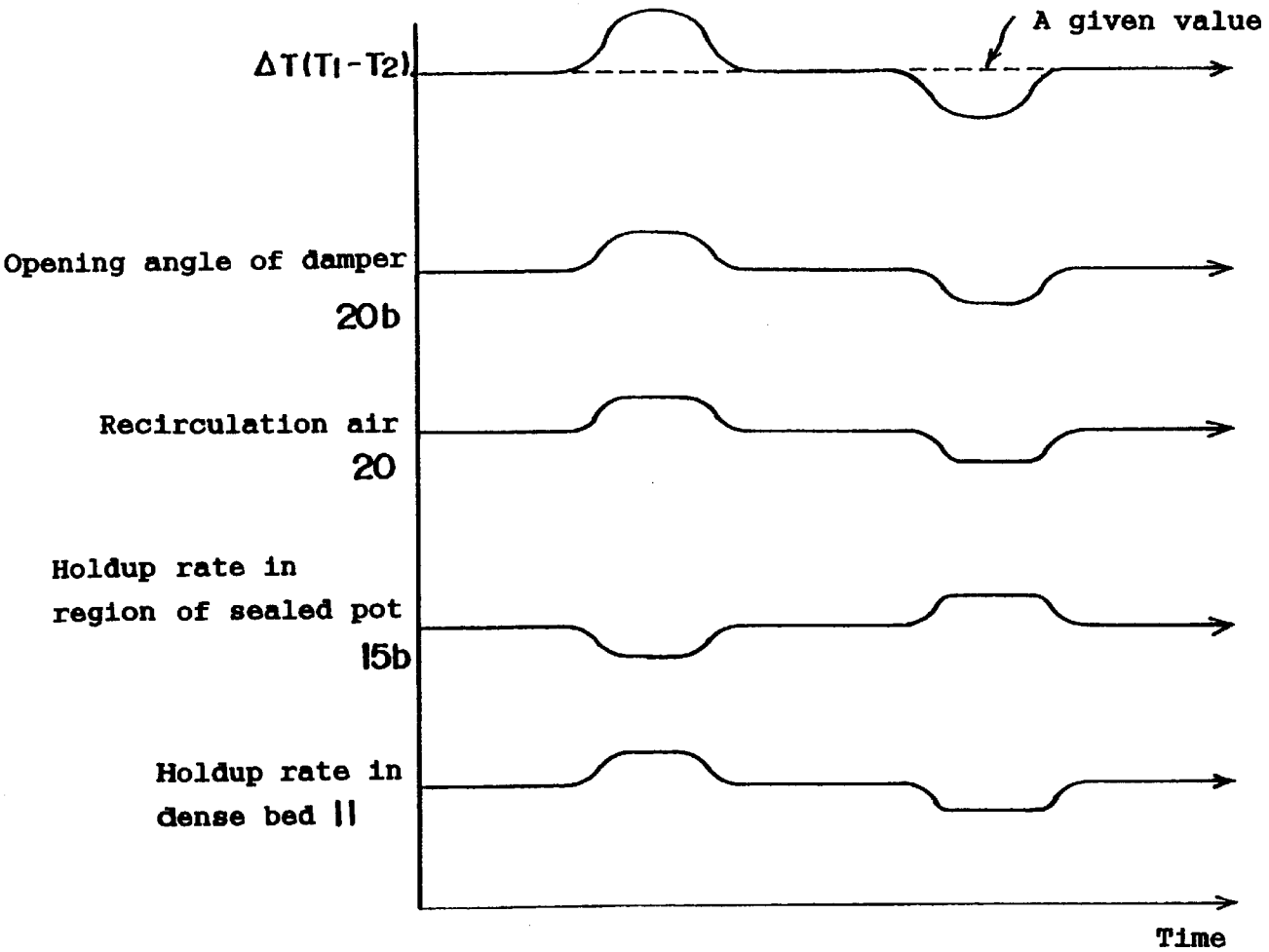
FIG. 11 illustrates the time chart (1) of the third preferred embodiment.

In FIGS. 3 and 4, 011 is a fluidized bed incinerator. The second preferred embodiment of this invention has the following configuration. The said fluidized bed incinerator 011 consists of: a fluidizing region 10, in which primary air 18 is blown into the bed containing sand 10*d*, the fluidizing medium consisting of silica or the like, through gas dispersion device 18*c*, which is located on the bottom of the tower, in order to fluidize the sand; an entraining area 12, into which secondary air 25 is introduced, to entrain and convey the aforesaid sand 10*d* into the freeboard 13 above it, from any of channels 22, 23 or 24 through 1 or more, as selected by control unit 30, of inlets 22*a*, 23*a* or 24*a*, provided at three heights on the wall of the tower in splash zone 12*b*, into which sand 10*d* is carried when bubbles on surface 12*a* of the said fluidized bed 10 burst; recirculation unit 100, which entrains and conveys the aforesaid sand 10*d* which has been flung into splash zone 12*b*, on air introduced through whichever of the said channels 22, 23 or 24 was selected, through the freeboard 13 above it and out of the furnace, passes the sand through separator 14, a cyclone or other device to separate the sand from the exhaust gas, sealed pot 15, and duct 15*c*, and recirculates it to the aforesaid fluidizing region 10; control unit 101, which consists of dampers 18*b* and 25*b* in gas supply system 17, and which adjusts the proportion of the aforesaid primary air and secondary air 25; and a selection device, consisting of dampers 22*b*, 23*b* and 24*b*, which select, according to control unit 30, one or more of inlets 22*a*, 23*a* or 24*a* to admit the secondary air 25 supplied by means of the aforesaid damper 25*b*.

The aforesaid control unit 30 detects temperatures $T_1$ and $T_2$ in freeboard 13 and the aforesaid fluidizing region 10 by temperature detectors 30*a* and 30*b*, respectively. It selectively opens or adjusts the opening of dampers 22*b*, 23*b* and

24*b* in order to keep the temperature differential $\Delta T$ ($T_1$–$T_2$) between the two regions in a specified range.

While opening or closing dampers 18*b* and 25*b* to control the proportion of primary air 18 to secondary air 25, the aforesaid gas supply system 17 admits primary air to inlet 18*a* and selectively admits secondary air to inlets 22*a*, 23*a* or 24*a*.

By controlling dampers 18*b* and 25*b*, we can determine according to a rule the total quantity of the aforesaid primary and secondary air which will be admitted to the furnace to correspond to the characteristics and the quantity of waste product. The primary air 18 whose proportion is controlled by the aforesaid damper 18*b* is injected into the bottom of the tower through inlet 18*a* and distributed by device 18*c*. When it reaches the fluidizing speed, the sand 10*d* in fluidizing region 10 begins to act as a fluid, forming splash zone 12*b* and fluid surface 12*a*.

In other words, damper 18*b* can be adjusted to increase the velocity of the aforesaid primary air 18. When this velocity exceeds the initial bubbling velocity, bubbles begin to form in fluidizing region 10. These bubbles agitate the sand in the interior of the bed, forming a non-uniform fluidized bed.

If the velocity of the air is further increased, particles of sand 10*d* will begin to be thrust upward from fluid surface 12*a* in region 10, forming splash zone 12*b* above the bed.

In this case, damper 18*b* of gas supply system 17 is adjusted to increase or decrease the proportion of the aforesaid primary air 18 in order to control the temperature of fluidizing region 10 and the suspension density in freeboard 13. To be more specific, the density of the suspension is kept between 1.5 kg/m$^3$ and 10 kg/m$^3$.

In the aforesaid splash zone 12*b*, as was discussed earlier, there are three inlets for secondary air, 22*a*, 23*a* and 24*a*, at three different heights on the wall of the tower. These form a space of inhomogeneous density with respect to the bed surface 12*a* below it. Inlet 16, through which the substance to be incinerated (waste material) is loaded, is an appropriate distance above the aforesaid bed surface 12*a*.

Exhaust gas vent 14*a* is on the top of the aforesaid separator 14, which consists of a cyclone. Through it, the exhaust gas 35 from which the entrained sand 10*d* has been separated is released to the exterior.

In splash zone 12*b* there are three inlets for secondary air, 22*a*, 23*a* and 24*a*, each with its respective damper 22*b*, 23*b* and 24*b*. These inlets and dampers form an inlet unit extending vertically along the wall of the tower. The secondary air 25 whose proportion is controlled by damper 25*b* is admitted to the furnace selectively by adjusting dampers 22*b*, 23*b* and 24*b* in tandem, or by adjusting each damper separately. By adjusting these dampers, as will be discussed shortly, control unit 30 can maintain the differential between detected temperatures $T_1$ in freeboard 13 and $T_2$ in fluidizing region 10 at an appropriate value. In this way the control unit can insure that the suspension density in freeboard 13 and the recirculation rate remain at their proper values. Entraining region 12 is formed in splash zone 12*b*, with its three inlets (22*a*, 23*a* and 24*a*) for secondary air 25, and in freeboard 13 above the splash zone.

In this apparatus, when the bubbles in splash zone 12*b* burst, some of the sand particles 10*d* which constitute the fluidizing medium are separated from the surface on which they are floating, causing the secondary air 25, which is controlled as to its proportion of the air mixture, to form a splash zone with a vertical differential. The secondary air is selectively admitted via one or more of channels 22 (upper), 23 (middle) or 24 (lower) and conveyed into freeboard 13 along with primary air 18. When it passes through separator 14, a cyclone or some similar device located beyond the tower, the exhaust gas 35, as was discussed earlier, is released through vent 14*a* on the top of the separator. The sand 10*d* recovered in separator 14 accumulates in region 15*a* of the sealed pot 15 below the separator.

Blower 17*b* injects air into the aforesaid sealed pot 15 through channels 20 and 21, causing the sand to accumulate in region 15*a*. The sand 10*d* which finds its way into pressurized region 15*b* is recirculated through duct 10*c* to fluidizing region 10. 20*b* and 21*b* are the dampers which open and close the said air channels 20 and 21.

When this fluidized bed incinerator operates, dampers 18*b* and 25*b* of gas supply system 17 are adjusted in response to the fuel characteristics and quantity of the sludge or other substance loaded via inlet 16. In this way the total quantity of primary air 18 and secondary air 25 is controlled, the quantity of sand 10*d* which will recirculate is determined, and the proportion of primary to secondary air is established.

The ratio of primary air 18 to secondary air 25, which is regulated by adjusting dampers 18*b* and 25*b*, sets the holdup rate and the suspension density of sand 10*d* in bed region 10, splash zone 12*b* and freehold 13, and it controls the temperature in freehold 13 and bed region 10. For example, in order to achieve a suspension density between 1.5 kg/m$^3$ and 10 kg/m$^3$, the ratio of primary air 18 to secondary air 19 is set somewhere between 1 to 2 and 2 to 1.

In response to the fuel characteristics of the sludge or other substance loaded into the furnace, an appropriate proportion of secondary air 25 is supplied selectively through upper, middle and lower channels 22, 23 and 24. The fundamental quantity is supplied via middle channel 23. It would, of course, be possible to control the proportion by admitting two or more streams of secondary air in parallel via different channels.

Figure 8:
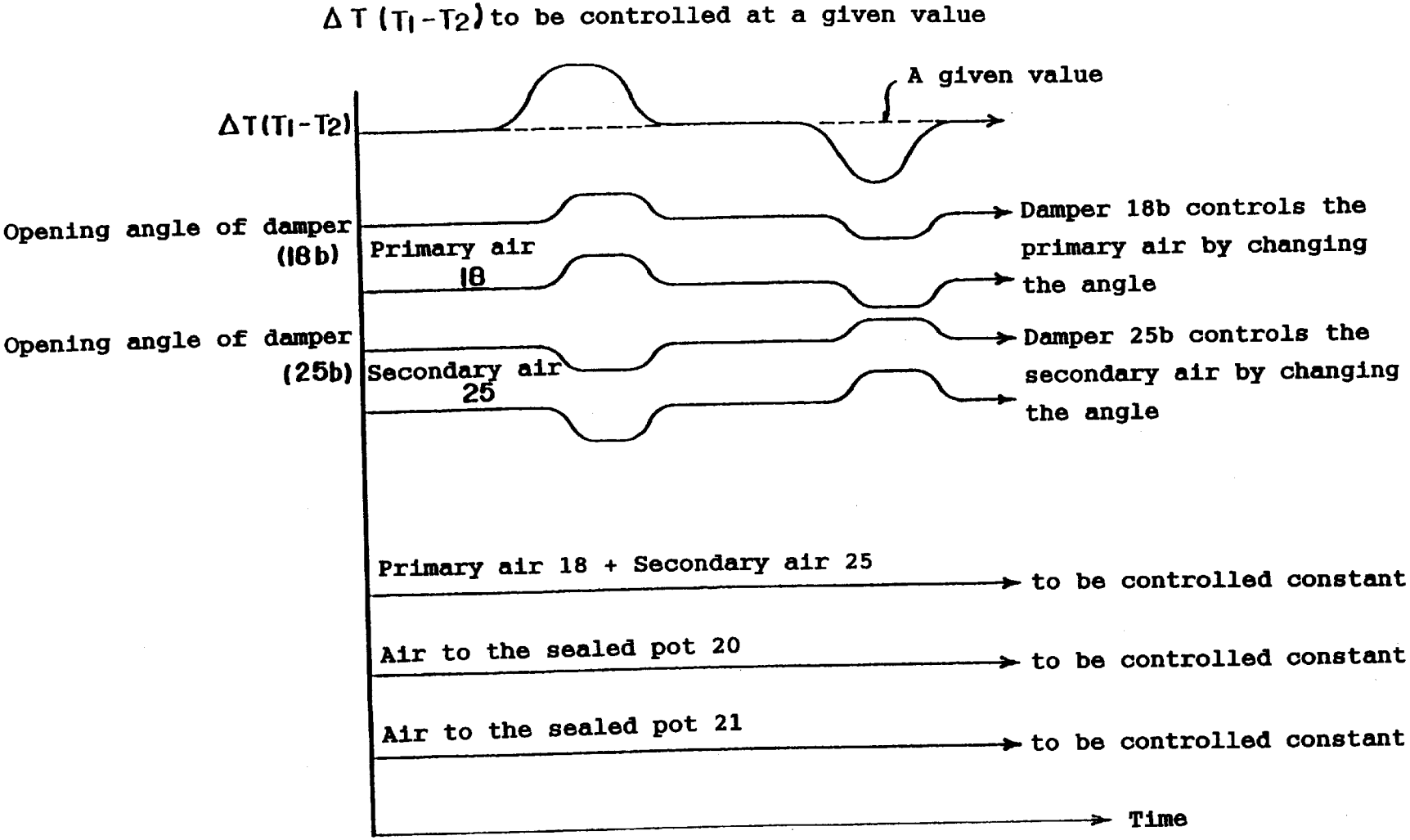
FIG. 8 illustrates the time chart (3) of the second preferred embodiment.

The control state of the temperature achieved by adjusting the ratio of primary air 18 to secondary air 25 in this second embodiment is explained by the time chart in FIG. 8.

In this time chart, the control state pictured for the ratio of primary air 18 to secondary air 25 is such that the difference between the temperature $T_1$ in freeboard 13 and the temperature $T_2$ in bed region 10 is a given value.

A control signal from control unit 30 opens or closes dampers 18*b* and 25*b*. The sum of the quantities of primary air 18 and secondary air 25, the quantity of sand 10*d* which is in circulation, and the quantity of air sent to sealed pot 15 are all kept constant so that the quantity of sand 10*d* which is recirculated is kept constant.

As can be seen in FIG. 8, when $\Delta T$ ($T_1$–$T_2$) exceeds a given value, a signal from control unit 30 causes damper 18*b* for primary air 18 to open more and damper 25*b* for secondary air 25 to close more. This increases the proportion of primary air 18 in the mixture, and decreases the proportion of secondary air 25, which raises the temperature $T_2$ of bed region 10 and lowers the temperature $T_1$ of freeboard 13.

In contrast, when $\Delta T$ ($T_1$–$T_2$) falls below a given value, a signal from control unit 30 causes damper 18*b* for primary air 18 to close more and damper 25*b* for secondary air 25 to open more. This decreases the proportion of primary air 18 in the mixture, and increases the proportion of secondary air 25, which lowers the temperature $T_2$ of bed region 10 and raises the temperature $T_1$ of freeboard 13.

The ratio of primary air 18 to secondary air 25 is adjusted by the aforesaid control device, which changes the holdup rate and the suspension density in bed region 10 and freeboard 13, so that these quantities countervary in proportion to each other in the two regions. The sand is recirculated to the aforesaid bed region 10 by way of sealed pot 15 and duct 15*c* in order to control the temperature of region 10. Since their fuel characteristics will vary widely, such a roundabout control method will not provide swift and accurate control for the incineration of substances like sludge which contain a great deal of moisture.

This embodiment addresses just such a problem. As can be seen in the time chart in FIG. 5, the ratio of primary air 18 to secondary air 25 is controlled as in FIG. 8 or kept constant, and a quantity of secondary air 25 which is adjusted to maintain the proper proportion can be admitted selectively via upper, middle and lower channels 22, 23 and 24 to control the temperatures swiftly and accurately.

In the time chart shown in FIG. 5, secondary air is admitted via middle channel 23 by opening middle damper 23*b* and closing dampers 22*b* and 24*b* above and below it. If, in this state, the aforesaid temperature differential $\Delta T$ $(T_1-T_2)$ exceeds its upper limit value, middle damper 23*b* will be closed and lower damper 24*b* will be opened, causing secondary air 25 to be admitted past damper 24*b* via lower inlet 24*a*. The aforesaid sand 10*d* will be flung upward from the vicinity of bed surface 12*a*, on which the aforesaid particles comprising the many layers of sand 10*d* are floating. These particles will be entrained and carried into freeboard 13. The holdup rate will increase and the suspension density in freeboard 13 will increase to mitigate the excessive temperature spike, with the result that $\Delta T$ $(T_1-T_2)$ will drop below its upper limit value. After it drops, the system reverts to its previous control state, with middle damper 23*b* open and lower damper 24*b* closed.

If the aforesaid temperature differential $\Delta T$ $(T_1-T_2)$ falls below its lower limit value, middle damper 23*b* will be closed and upper damper 22*b* will be opened, causing secondary air 25 to be admitted past damper 22*b* via upper inlet 22*a*. The quantity of sand 10*d* in freeboard 13, i.e., the number of particles entrained and conveyed into the freeboard, will decrease, and the holdup rate and suspension density in freeboard 13 will fall, with the result that $\Delta T$ $(T_1-T_2)$ will rise above its lower limit value. After it rises, the system reverts to its previous control state, with middle damper 23*b* open and upper damper 22*b* closed.

Figure 5:
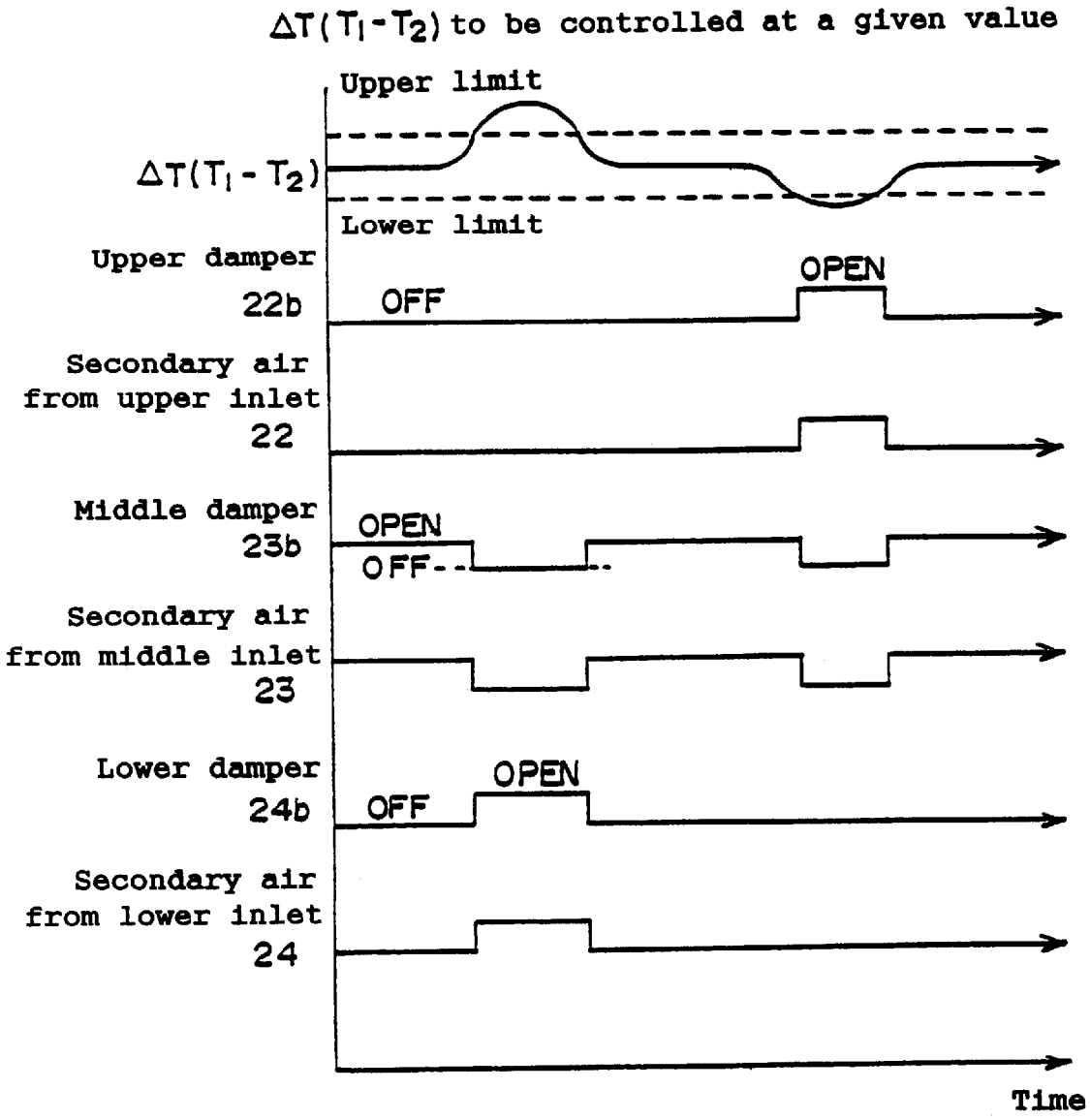
FIG. 5 illustrates the time chart (1) of the second preferred embodiment.

In FIG. 5, the sum of the quantities of primary air 13 and secondary air 25 remains constant and the quantity of air injected into sealed pot 15 remains constant, just as in FIG. 8.

To prevent the dampers from being opened and closed repeatedly in response to severe load fluctuations, in addition to the control operations shown in FIG. 8, the quantity of secondary air can also be adjusted by opening or closing inlet 25 via damper 25*b* when $\Delta T$ exceeds its upper limit value continuously over a specified period of time. Alternatively, two or all three of the inlets may be closed or opened simultaneously by turning their aforesaid dampers on or off as needed.

Figure 6:
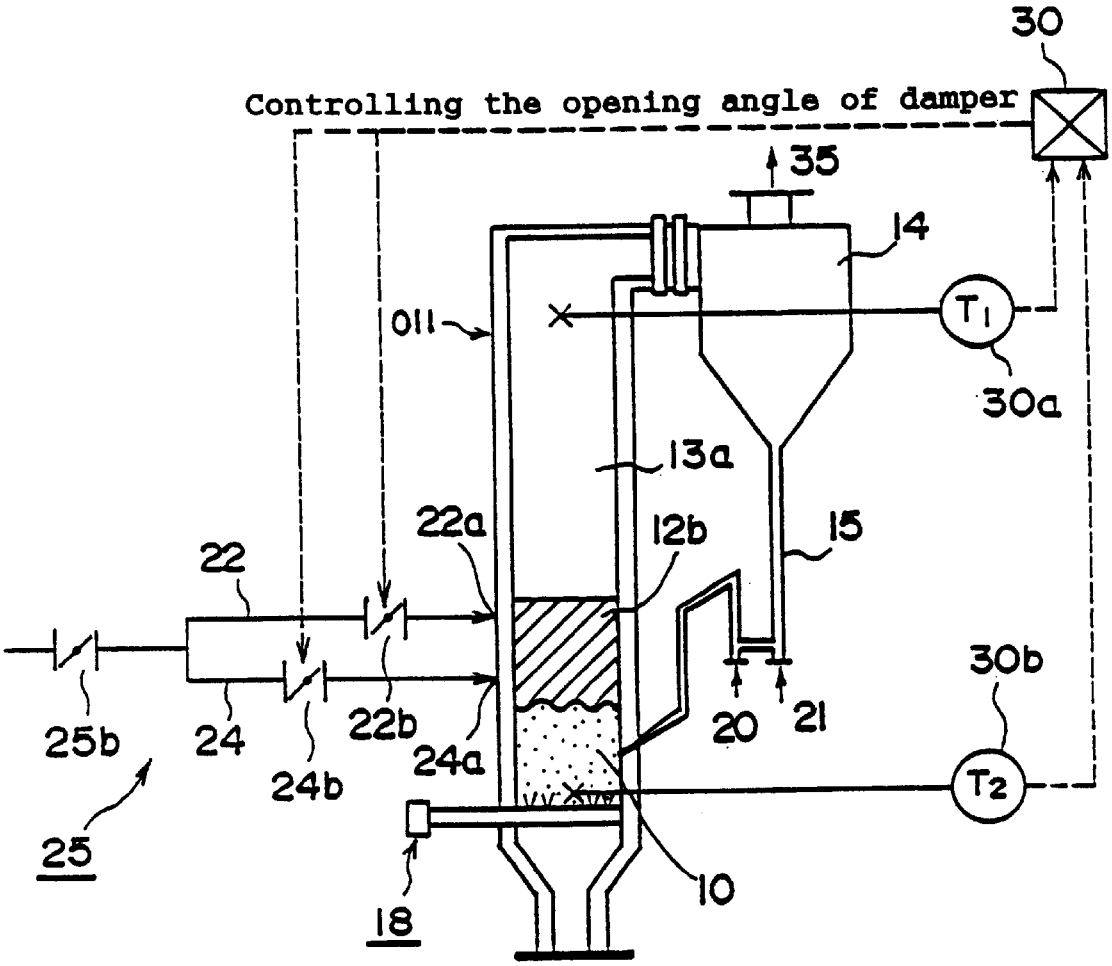
FIG. 6 illustrates the operational sketch (2) of the fluidized bed incinerator according to the second preferred embodiment of this invention.

In FIG. 6, upper and lower channels 22 and 24 admit the aforesaid secondary air 25. Air may thus be admitted as needed to respond to specific circumstances. In the drawing, inlets 22*a* and 24*a* are arrayed vertically in splash zone 12*b*. Temperatures $T_1$ and $T_2$ in freeboard 13 and bed region 10, respectively, are detected by temperature detectors 30*a* and 30*b*, respectively. Control unit 3 adjusts dampers 22*b* and 24*b* to fully open, 50% or fully closed so as to insure that the temperature differential $\Delta T$ between the two regions remains in the given range.

Figure 7:
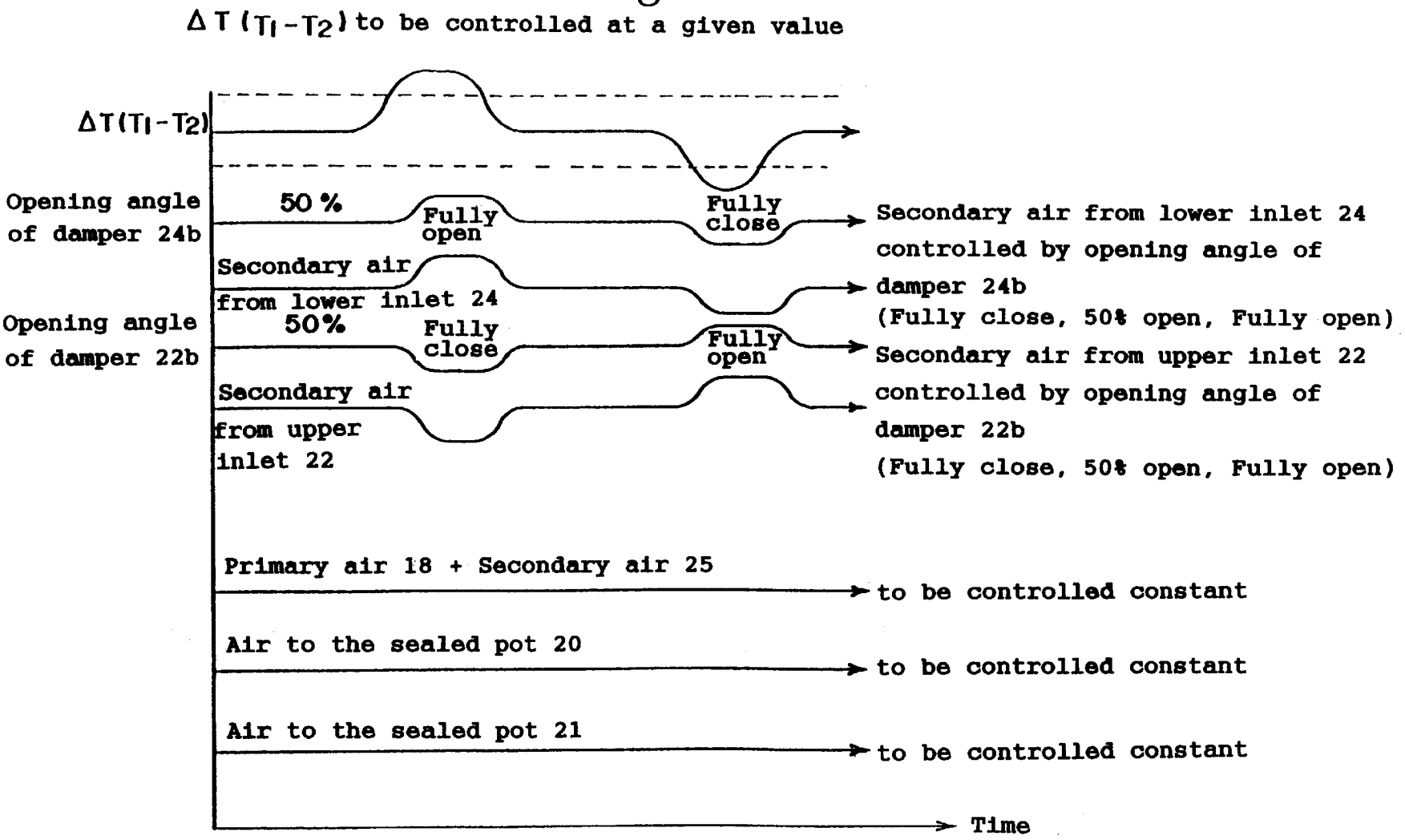
FIG. 7 illustrates the time chart (2) of the second preferred embodiment.

In the time chart shown in FIG. 7, the device in FIG. 6 has both its upper and lower dampers 22*b* and 24*b* 50% open so that secondary air 25 is admitted via both channels 22 and 24. If, in this state, the aforesaid temperature differential $\Delta T$ $(T_1-T_2)$ exceeds its upper limit value, upper damper 22*b* is fully closed and lower damper 24*b* is fully opened, causing secondary air 25 to be admitted only past damper 24*b* via lower inlet 24*a*. This will cause $\Delta T$ $(T_1-T_2)$ to drop below its upper limit value. After it drops, dampers 22*b* and 24*b* revert to their original control state of 50% open.

If the aforesaid temperature differential $\Delta T$ $(T_1-T_2)$ falls below its lower limit value, lower damper 24*b* is fully closed and upper damper 22*b* is fully opened, causing secondary air 25 to be admitted only past damper 22*b* via upper inlet 22*a*. This will cause the rate at which the aforesaid sand particles are conveyed into freeboard 13 to drop, resulting in a lower holdup rate and a lower suspension density in the freeboard, and $\Delta T$ $(T_1-T_2)$ will climb above its lower limit value. After it climbs, the system reverts to its original control state.

Third Preferred Embodiment

Figure 9:
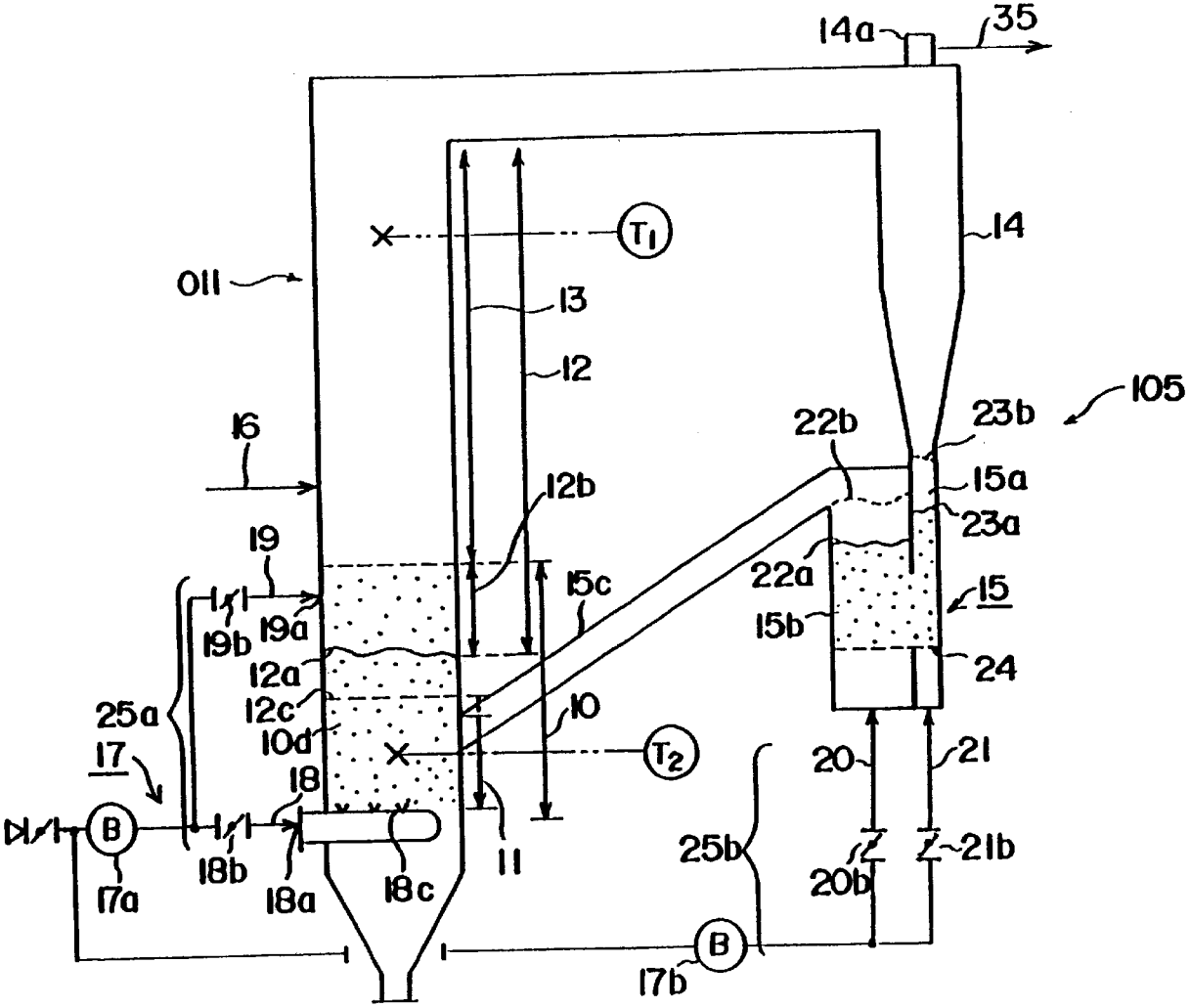
FIG. 9 illustrates the rough sketch of the fluidized bed incinerator according to the third preferred embodiment of this invention.

In FIG. 9, 011 is a fluidized bed incinerator which is the third preferred embodiment of this invention. This incinerator has the following configuration.

The said fluidized bed incinerator 011 has the following components. Fluidizing region 10 contains a mass of sand 10*d*, consisting of silica or some similar substance to serve as the fluidizing medium. Region 10 has a dense bed 11 on which static bed 12*c* is formed. Primary air 18 is blown into dense bed 11. The interior of the said dense bed 11 is fluidized by air bubbles and forms fluid surface 12*a*. As the bubbles burst, the particles of sand are thrust upward to form splash zone 12*b*. Secondary air 19, which entrains and conveys the grains of sand to the aforesaid splash zone, is admitted to the furnace and conveys the particles which serve as the fluidizing medium into freeboard 13, located above the fluidizing region.

The said fluidized bed incinerator 011 also has a separator 14, a cyclone or other device which conveys the aforesaid entrained fluidizing medium out of the furnace, separates it from the gas and collects it; an external recirculation unit 105, consisting of sealed pot 15, which recirculates the collected fluidizing medium, by way of duct 15*c*, to dense bed 11 in the aforesaid fluidizing region 10; a blower 17*a*, which controls the total quantity of the aforesaid primary air 18 and secondary air 19; control system 25*a*, which controls the ratio of primary air 18 to secondary air 19; a blower 17*b*, which sends air into the aforesaid sealed pot 15; and a gas supply system 17, which consists of control system 25*b*.

Temperature gauges $T_1$ and $T_2$ measure the temperature in the aforesaid freeboard 13 and fluidizing region 10, respectively. Control systems 25*a* and 25*b* of gas supply system 17 are controlled according to the temperatures detected.

The aforesaid gas supply system 17, as was discussed earlier, consists of blowers 17*a* and 17*b* and the control systems 25*a* and 25*b* which control the air supplied by these blowers.

In control system 25*a*, the air propelled by blower 17*a* can be adjusted by opening or closing dampers 18*b* and 19*b* to change the ratio of primary to secondary air.

In control system 25*b*, the air propelled by blower 17*b* can be adjusted by opening or closing dampers 20*b* and 21*b* to execute the control we shall discuss shortly.

The total quantity of primary air 18 and secondary air 19, which is the sum of primary air 18, the aforesaid fluidizing air, and secondary air 19, the entraining air, is controlled by the quantity of air supplied by blower 17*a*. Primary air 18, whose proportion is controlled by damper 18*b*, is distributed into the lower portion of the tower by distribution device 18*c* after entering through inlet 18*a*. When the air reaches the initial fluidizing velocity, sand 10*d*, the fluidizing medium constituting dense bed 11 in fluidizing region 10, begins to act like a fluid, forming a uniform fluidized bed with a surface 12*a*. The velocity of the air in the tower is increased until it exceeds the velocity for air bubble fluidization. The bubbles which are generated agitate the interior of the bed, causing it to assume a state of non-uniform fluidization, and forming bubble-fluidized region 10. This makes it possible for sand particles to be thrust upward when the bubbles on the aforesaid surface 12*a* burst, thus creating splash zone 12*b*.

In this case, adjusting damper 18*b* of control system 25*a*, which is part of the aforesaid gas supply system 17 will increase or decrease the ratio of the said primary air 18 to secondary air 19. By increasing or decreasing the temperature in region 10 and the quantity of circulating particles which pass through freeboard 13, we can control the suspension density in the said freeboard 13.

The secondary air 19 which is decreased or increased by adjusting damper 19*b* in response to the increase or decrease of primary air 18 by the control operation described above entrains and conveys the particles of medium thrown up into splash zone 12*b*. When the appropriate suspension density has been achieved with respect to the aforesaid freeboard 13 to compensate for load variation, the aforesaid particles are collected by external recirculation unit 105, which consists of separator 14 and sealed pot 15. The particles which are collected are recirculated as needed to dense bed 11 in the aforesaid fluidizing region 10 by way of duct 15*c*. The combustion heat from freeboard 13 is also recirculated to prevent the combustion temperature in region 10 from slipping so as to maintain stable combustion.

Figure 10:
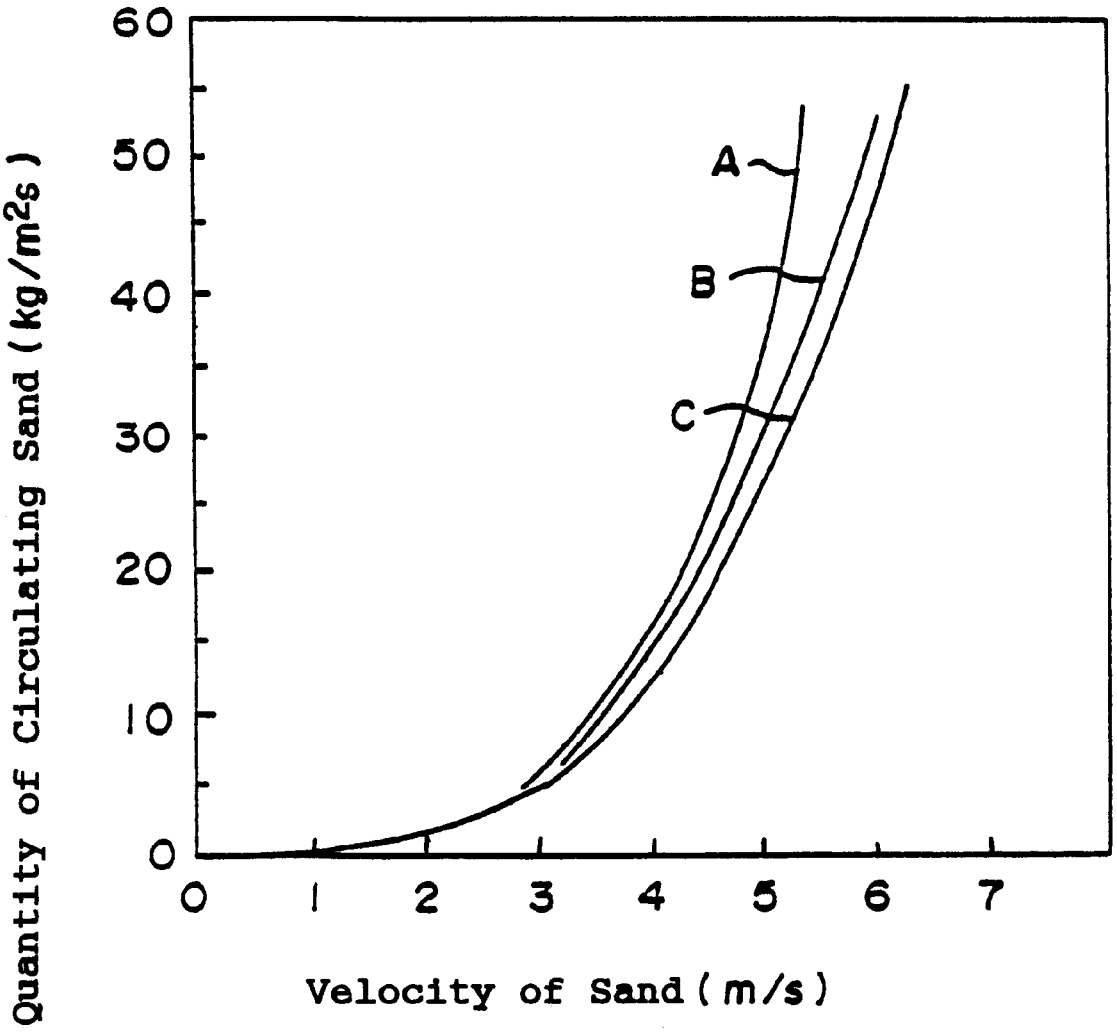
FIG. 10 illustrates how the fluidizing sand flows in the third and fourth preferred embodiments of this invention.

When the aforesaid particles are recirculated to dense bed 11, the quantity of sand 10*d* in the dense bed is increased. When the quantity of sand increases the holdup rate in the combustion chamber in freeboard 13 also increases, as is shown in FIG. 10. The suspension density in the said freeboard 13 can actually be adjusted so that it is between 1.5 kg/m$^3$ and 10 kg/m$^3$. Local or momentary temperature abnormalities (actually, temperature spikes) due to load fluctuations can be addressed by adjustment of the suspension density, which is accomplished by changing the ratio of the aforesaid primary air 18 to secondary air 19. In this way such fluctuations can be reliably absorbed.

In order to make it possible to adjust the suspension density in freeboard 13 and the quantity of particles recirculated by controlling the pressure in the aforesaid sealed pot 15, the pot is divided by a vertical wall into two regions. These are region 15*a*, where the particles captured by the said separator 14 accumulate when air is blown into the region below the separator via channel 21; and region 15*b*, on the same side of the pot as duct 15*c*, from which region the accumulated particles are recirculated to dense bed 11 via duct 15 when air is blown into the region via channel 20. Below regions 15*a* and 15*b* are dampers 20*b* and 21*b*, respectively. The air to control the accumulation of the sand and the air to control its recirculation can be applied independently through channels 21 and 20.

The aforesaid recirculation air 20 is blown into region 15*b* from beneath according to the adjustment of damper 20*b*. This causes the volume of the bed material in region 15*b* to increase. The surface of the bed rises from 22*a* to 22*b*, causing particles to overflow into duct 15*c* and return to dense bed 11.

When sand is recirculated as described above, the quantity of sand 10*d* in dense bed 11 is increased. As a result, the holdup rate in the combustion chamber rises and the suspension density in freehold 13 increases, thus compensating for sudden load fluctuations.

When a fluidized bed incinerator 011 with this configuration operates, the suspension density resulting from the holdup rate of the sand (i.e., the fluidizing medium) in freeboard 13 is preset to range from 1.5 kg/m$^3$ to 10 kg/m$^3$. The average mass flow velocity Gs of the particles (i.e., of the fluidized sand) is set according to the expected temperature drop of the exhaust gas (the temperature of the exhaust gas is between 800 and 1000° C.) when sand is added to the chamber (the specific heat of the sand is 0.2 Kcal/Kg° C.), and the height at which secondary air 19 is to be injected is determined. The total quantity of primary air 18 and secondary air 19 needed to fully combust the waste material is determined according to a rule. The quantity of particles to be recirculated varies with the suspension density.

From the upper and lower limits of the suspension density, the ratio of primary air 18 to secondary air 19 is set somewhere between one to two and two to one.

The airflow obtained from blower 17*a* in the aforesaid gas supply system 17 is divided by dampers 18*b* and 19*b* in control system 25*a* into primary air 18 and secondary air 19. The air flow from blower 17*b* is adjusted by dampers 21*b* and 20*b* in control system 25*b* to control the quantities of recirculation air (20) and accumulation air (21) which are blown into the sealed pot.

In the time chart shown in FIG. 11, when the temperature differential $\Delta T$ between the temperature $T_1$ in the aforesaid freeboard 13 and the temperature $T_2$ in fluidizing region 10 exceeds a given value, damper 20*b* is opened to admit recirculation air 20, and sand (particles) from region 15*b* of the sealed pot is recirculated to dense bed 11. The holdup rate in the freeboard falls, and the holdup rate of the sand in dense bed 11 increases.

We have chosen to control $\Delta T$ because it offers a simple way to maintain the proper suspension density and recirculation rate. It would also be possible to measure the suspension density and recirculation rate directly.

Thus the combustion heat from freeboard 13 can be recirculated to fluidizing region 10, while the actual suspension density can be adjusted so that it remains between 1.5 kg/m$^3$ and 10 kg/m$^3$.

Figure 12:
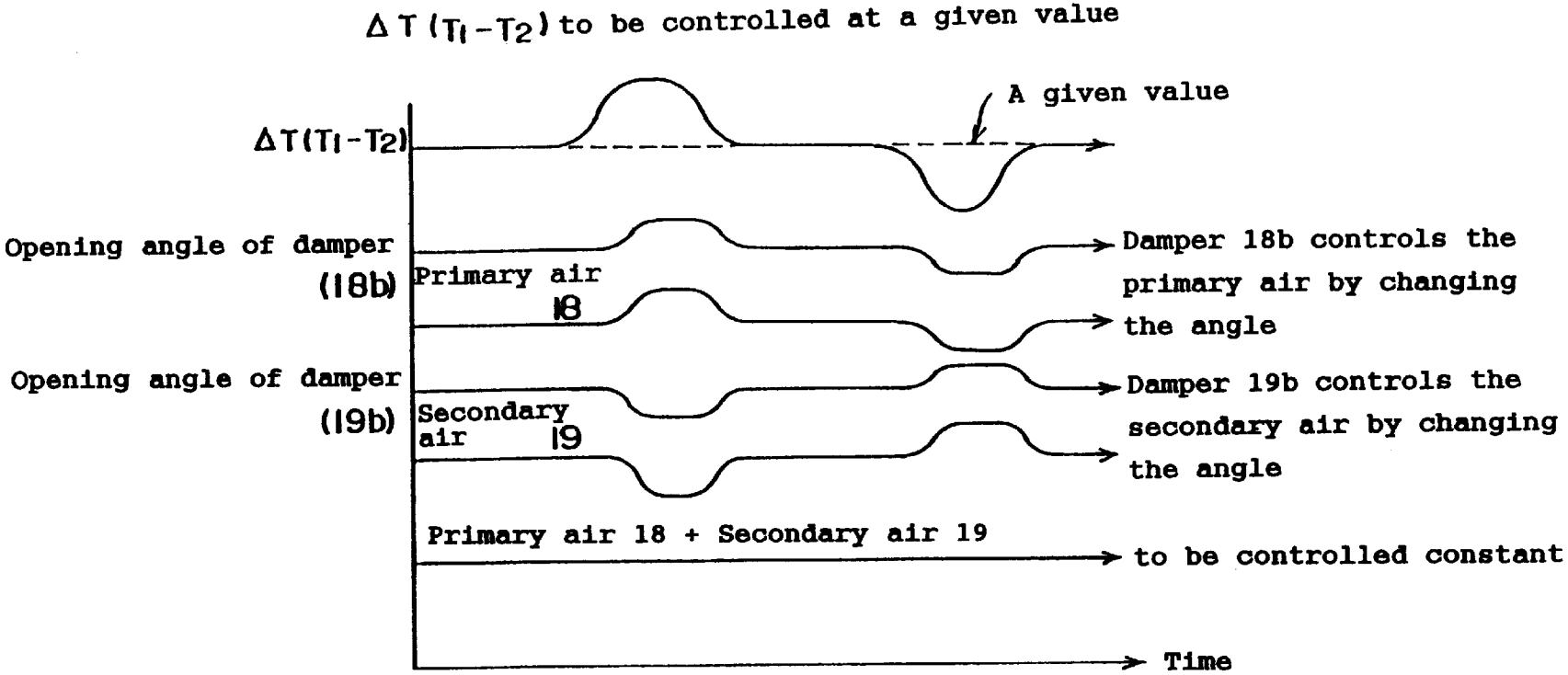
FIG. 12 illustrates the time chart (2) of the third preferred embodiment, and the fourth and fifth preferred embodiments which will be described later.

The control state of the temperatures achieved by adjusting the ratio of primary air 18 to secondary air 19 is explained by the time chart in FIG. 12.

In this time chart, the ratio of primary air 18 to secondary air 19 is controlled so that the difference $\Delta T$ $(T_1-T_2)$ between the temperature $T_1$ in freeboard 13 and the temperature $T_2$ of fluidizing bed 10 remains constant at a given value.

In this graph, the sum of the quantities of primary air 18 and secondary air 19 provided by blower 17*a* remains constant, and the rate at which the fluidizing medium (i.e., the sand) is recirculated also remains constant.

As is shown in FIG. 12, when the difference $\Delta T$ $(T_1-T_2)$ between furnace temperatures $T_1$ and $T_2$ exceeds a given value, control system 25*a* operates, the damper 18*b* for primary air 18 is opened more and the damper 19*b* for secondary air 19 is closed more. This increases the proportion of primary air 18 and decreases the proportion of secondary air 19. The temperature $T_2$ of fluidizing region 10 increases, and the temperature $T_1$ of freeboard 13 decreases.

When the difference $\Delta T$ ($T_1$–T2) between temperatures $T_1$ and $T_2$ falls below a given value, the damper 18*b* for primary air 18 is closed more and the damper 19*b* for secondary air 19 is opened more. This decreases the proportion of primary air 18 and increases the proportion of secondary air 19. The temperature $T_2$ of fluidizing region 10 decreases, and the temperature $T_1$ of freeboard 13 increases.

Controlling the ratio of primary air 18 to secondary air 19 yields the result of controlling the holdup rate and suspension density in bed 10 and freeboard 13, which are in an inverse relationship with each other. By adjusting the quantities of recirculation air 20 and accumulation air 21 which are injected into the aforesaid sealed pot 15, we can control the holdup rate in freeboard 13 as well as the suspension density over a wide range of values.

Fourth Preferred Embodiment

Figure 13:
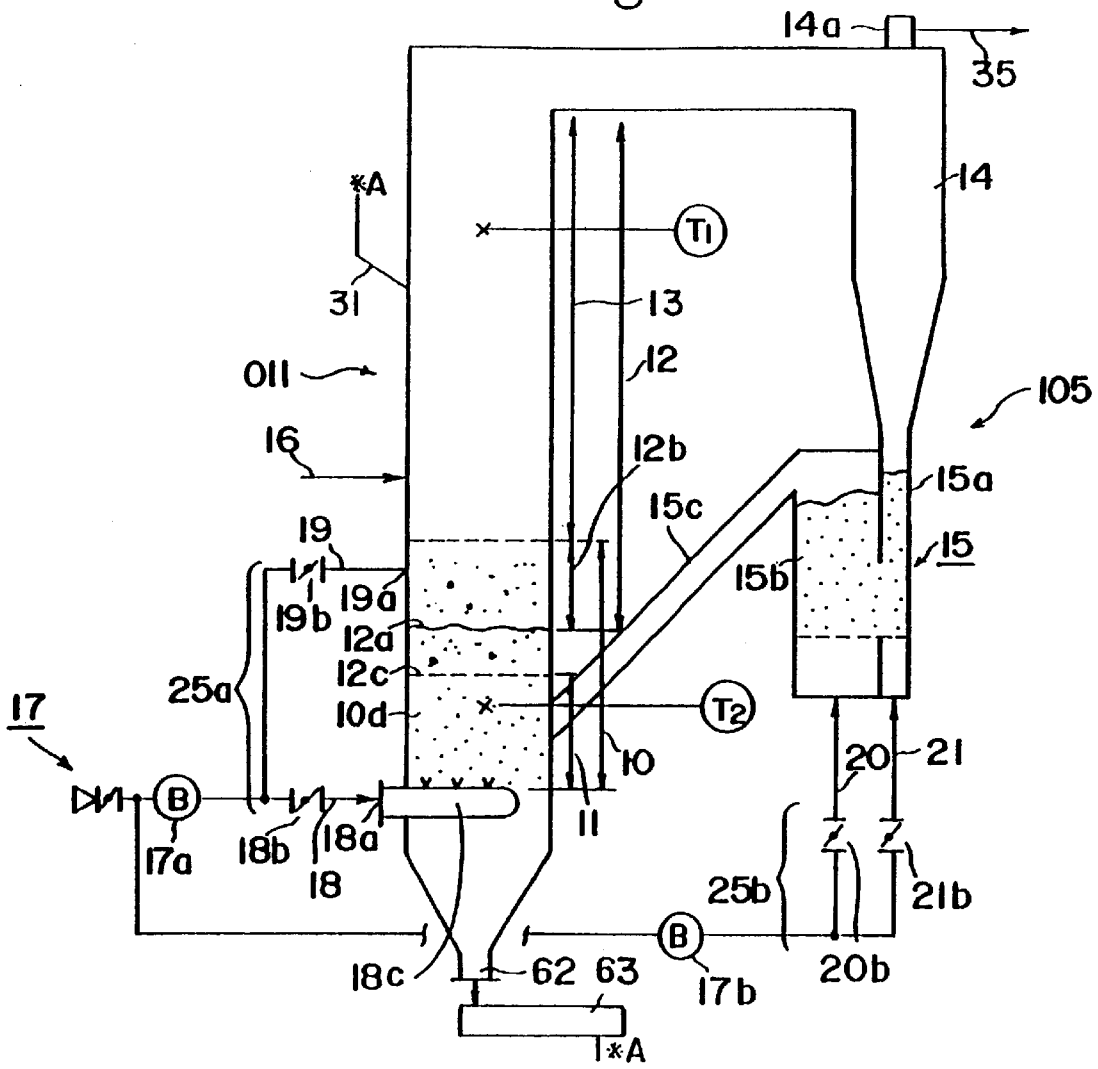
FIG. 13 illustrates the rough sketch of the fluidized bed incinerator according to the fourth preferred embodiment of this invention.

In FIG. 13, 011 is a fluidized bed incinerator which is the fourth preferred embodiment of this invention. Its configuration is as follows.

The said fluidized bed incinerator 011 has the following configuration. Primary air 18 is blown into dense bed 11 through dispersion device 18*c*, which is located on the bottom of the tower. Dense bed 11, which consists of silica or some other sand 10*d* serving as the fluidizing medium, has a stationary surface 12*c*. The interior of the said dense bed 11 is fluidized by air bubbles, thus creating fluidized sand surface 12*a*. As the bubbles burst, particles of sand are flung upward to form splash zone 12*b* above bed region 10. Secondary air 19 is introduced into the aforesaid splash zone 12*b*. In entraining region 12, this secondary air entrains the particles of fluidizing medium thrust upward into the said splash zone 12*b* and conveys them into freeboard 13 above the splash zone.

The said fluidized bed incinerator 011 also consists of the following: a separator 14, a cyclone or other device which conveys the aforesaid entrained fluidizing medium out of the furnace, separates it from the gas and collects it; an external recirculation unit 105, consisting of sealed pot 15, which recirculates the collected fluidizing medium, by way of duct 15*c*, to dense bed 11 in the aforesaid fluidizing region 10; a blower 17*a*, which controls the total quantity of the aforesaid primary air 18 and secondary air 19; a control system 25*a*, which controls the ratio of primary air 18 to secondary air 19; a blower 17*b*, which sends air into the aforesaid sealed pot 15; a gas supply system 17, consisting of control system 25*b*, which controls the quantity of air provided by the said blower 17*b*; and an internal recirculation unit, consisting of device 63 to remove fluidizing medium from the furnace, which includes a buffer tank in outlet 62, an outlet for uncombusted material and fluidizing medium which is below the aforesaid bed region 10.

Temperature gauges $T_1$ and $T_2$ measure the temperature in the aforesaid freeboard 13 and fluidizing region 10, respectively. Control systems 17*a* and 17*b* in gas supply system 17 and the control unit 30 pictured in FIG. 14, which controls the introduction of fluidizing medium as part of the aforesaid internal recirculation unit, enable the system to respond to fluctuations in the furnace temperatures.

The aforesaid gas supply system 17 consists of blowers 17*a* and 17*b* and control systems 25*a* and 25*b*, which control the air supplied by these blowers.

In control system 25*a*, the proportion of air provided by blower 17*a* through each of the two channels is adjusted by opening or closing dampers 18*b* and 19*b*.

In control system 25*b*, the air provided by blower 17*b* controls the recirculation of particles to bed region 10. Dampers 20*b* and 21*b* are opened or closed to actuate external recirculation unit 105.

The total quantity of primary air 18 and secondary air 19, which is the sum of primary air 18 and secondary air 19, is determined according to a rule to correspond to the characteristics and quantity of the waste material and achieved by opening or closing dampers 18*b* and 19*b*. Primary air 18, whose proportion is controlled by damper 18*b*, is distributed uniformly into the lower portion of the tower by distribution device 18*c* after entering through inlet 18*a*. When the air reaches the initial fluidizing velocity, sand 10*d*, the fluidizing medium constituting dense bed 11 in fluidizing region 10, begins to act like a fluid, forming a uniform fluidized bed with a surface 12*a*. The velocity of the air in the tower is increased until it exceeds the velocity for air bubble fluidization. The bubbles which are generated agitate the interior of the bed, causing it to assume a state of non-uniform fluidization, and forming bubble-fluidized region 10. This makes it possible for sand particles to be thrust upward when the bubbles on the aforesaid surface 12*a* burst, thus creating splash zone 12*b*.

Damper 18*b* of control system 25*a* in the aforesaid gas supply system 17 is adjusted to increase or decrease the ratio of the aforesaid primary air 18 to secondary air 19 in order to control the temperature of fluidizing region 10 and the suspension density in freeboard 13, which it does by increasing or decreasing the quantity of particles which pass through freeboard 13. To be more specific, the density of the suspension is kept between 1.5 kg/m$^3$ and 10 kg/m$^3$.

When the aforesaid ratio of primary to secondary air is controlled, secondary air 19, whose quantity is decreased or increased by damper 19*b* in response to the increase or decrease in the quantity of primary air 18, entrains and conveys the particles of fluidizing medium which are thrown upward into splash zone 12*b*. The system is adjusted so that the suspension density of the said particles with respect to the aforesaid freeboard 13 remains within a specified range, namely, between 1.5 kg/m$^3$ and 10 kg/m$^3$. When the load fluctuation has been compensated for, the particles are collected by external recirculation unit 105, consisting of separator 14 and sealed pot 15. The particles which are collected are recirculated through the control unit in an appropriate manner and returned to dense bed 11 in fluidizing region 10. The combustion heat from the aforesaid freeboard 13 is also recirculated to prevent the combustion temperature in fluidizing region 10 from dropping so that stable combustion can be maintained.

Figure 14:
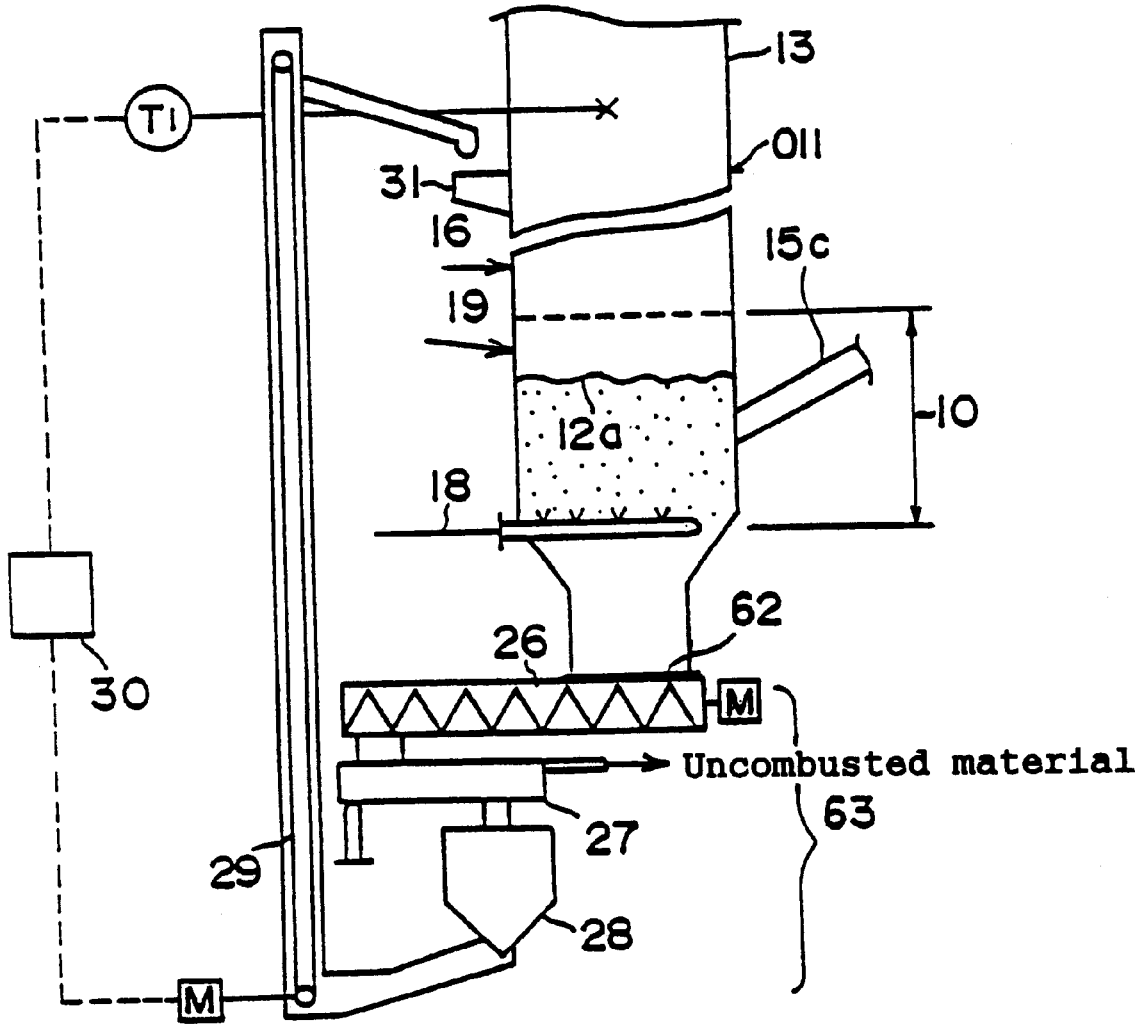
FIG. 14 illustrates the operational sketch of the fluidized bed incinerator according to the fourth preferred embodiment of this invention.

The aforesaid device 63 to remove the fluidizing medium, which is shown in FIG. 14, consists of an internal unit to recirculate the particles in the fluidized bed. This unit, which is installed on outlet 62 on the bottom of fluidizing region 10, consists of screw conveyor 26, sand separator 27, a device which vibrates a sieve, buffer tank (collection tank) 28, conveyor 29 and inlet 31.

In device 63 to remove the fluidizing medium, any uncombusted material such as incinerator ash is removed by screw conveyor 26 along with the fluidizing medium. The uncombusted material is removed by sand separator 27, a vibrating screen or the like, and the fluidizing medium is stored temporarily in buffer tank 28.

Figure 15:
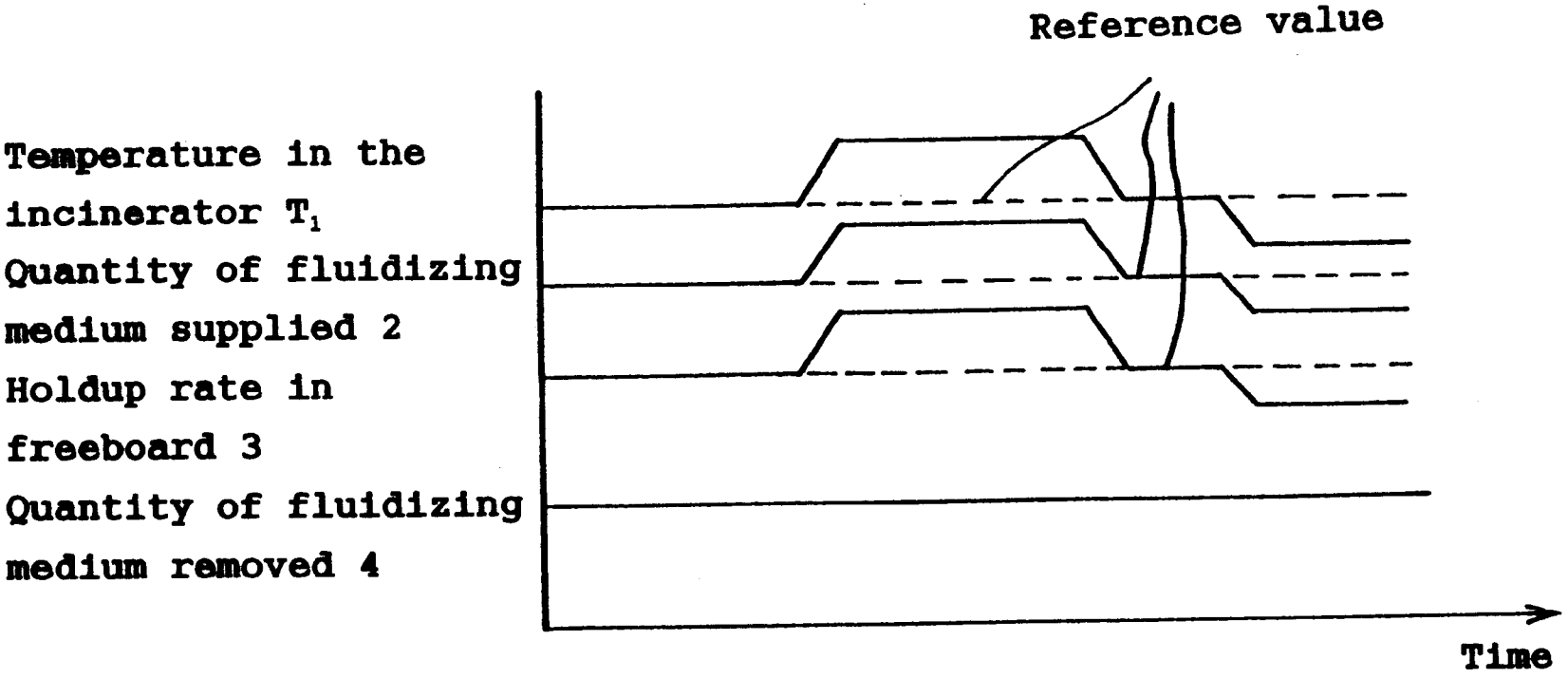
FIG. 15 illustrates the time chart (1) of the fourth preferred embodiment.

If the temperature $T_1$ measured by the thermometer in freeboard 13 exceeds a reference value, control unit 30 causes conveyor 29 to slow down, as shown in FIG. 15. Sand 10*d*, the fluidizing medium stored in buffer tank 28, is supplied to freeboard 13 via inlet 31 in a quantity determined by control unit 30 to be proportional to the excess heat.

As a result, the holdup rate of the particles in the aforesaid freeboard 13 is increased or decreased, as is the suspension density. Thus the system can respond to large temperature fluctuations in freeboard 13, as described above; and it can respond to a wide range of load fluctuations due to the waste material having different combustion characteristics. Because the fluidizing medium is removed by screw conveyor 26, which normally operates to remove ash and other uncombusted material, the quantity of medium which is removed remains constant.

When sand 10*d* which was stored previously in buffer tank 28 as described above is supplied to the furnace, the quantity of sand originally placed in the furnace is increased by the quantity supplied. As can be seen in FIG. 10 with respect to the third embodiment, by increasing the quantity of sand in circulation, we increase the thermal capacity of freeboard 13 and so fundamentally increase the furnace's ability to respond to the load.

When this sort of furnace operates, the suspension density resulting from the holdup rate of the sand (i.e., the fluidizing medium) in freeboard 13 is preset to range from 1.5 kg/m$^3$ to 10 kg/m$^3$. The average mass flow velocity Gs of the particles (i.e., of the fluidized sand) is set according to the expected temperature drop of the exhaust gas (the temperature of the exhaust gas is between 800 and 1000° C.) when sand is added to the chamber (the specific heat of the sand is 0.2 Kcal/Kg° C.), and the height at which secondary air 19 is to be injected is determined. The total quantity of primary air 18 and secondary air 19 needed to fully combust the waste material is determined, as is the quantity of medium to be recirculated.

From the upper and lower limits of the suspension density, namely 1.5 kg/m$^3$ and 10 kg/m$^3$, the ratio of primary air 18 to secondary air 19 is set somewhere between one to two and two to one.

The airflow obtained from blower 17*a* in the aforesaid gas supply system 17 is divided by dampers 18*b* and 19*b* in control system 25*a* into primary air 18 and secondary air 19. The airflow from blower 17*b* is sent by way of control system 25*b* to external recirculation unit 105. The fluidizing medium is recirculated to bed region 10.

The control state of the temperature achieved by adjusting the ratio of the aforesaid primary air 18 to secondary air 19 can be explained using the time chart in FIG. 12 with respect to the aforesaid embodiment.

In this time chart, the sum of the quantities of primary air 18 and secondary air 19 provided by blower 17*a* remains constant, as does the quantity of fluidizing medium (i.e., sand) in circulation. When the difference $\Delta T$ ($T_1$–$T_2$) between the aforesaid furnace temperatures $T_1$ and $T_2$ exceeds a given value, control system 25*a* operates; the damper 18*b* for primary air 18 is opened more and the damper 19*b* for secondary air 19 is closed more. This increases the proportion of primary air 18 and decreases the proportion of secondary air 19. The temperature $T_2$ of fluidizing region 10 increases, and the temperature $T_1$ of freeboard 13 decreases.

When the difference $\Delta T$ ($T_1$–$T_2$) between temperatures $T_1$ and $T_2$ falls below a given value, the damper 18*b* for primary air 18 is closed more and the damper 19*b* for secondary air 19 is opened more. This decreases the proportion of primary air 18 and increases the proportion of secondary air 19. The temperature $T_2$ of fluidizing region 10 decreases, and the temperature $T_1$ of freeboard 13 increases.

Controlling the ratio of primary air 18 to secondary air 19 yields the result of controlling the holdup rate and suspension density in bed 10 and freeboard 13, which are in an inverse relationship with each other. This being the case, there is a limit to the range of control which is possible. By supplying to freeboard 13 an appropriate quantity of the aforesaid fluidizing medium which has been removed from the furnace and stored in buffer tank 28, we can supply the quantity of particles needed to absorb any temperature spike in freeboard 13 by increasing the suspension density. The furnace can thus respond to a wide range of sudden temperature spikes resulting from fluctuations in the load characteristics.

Fifth Preferred Embodiment

Figure 16:
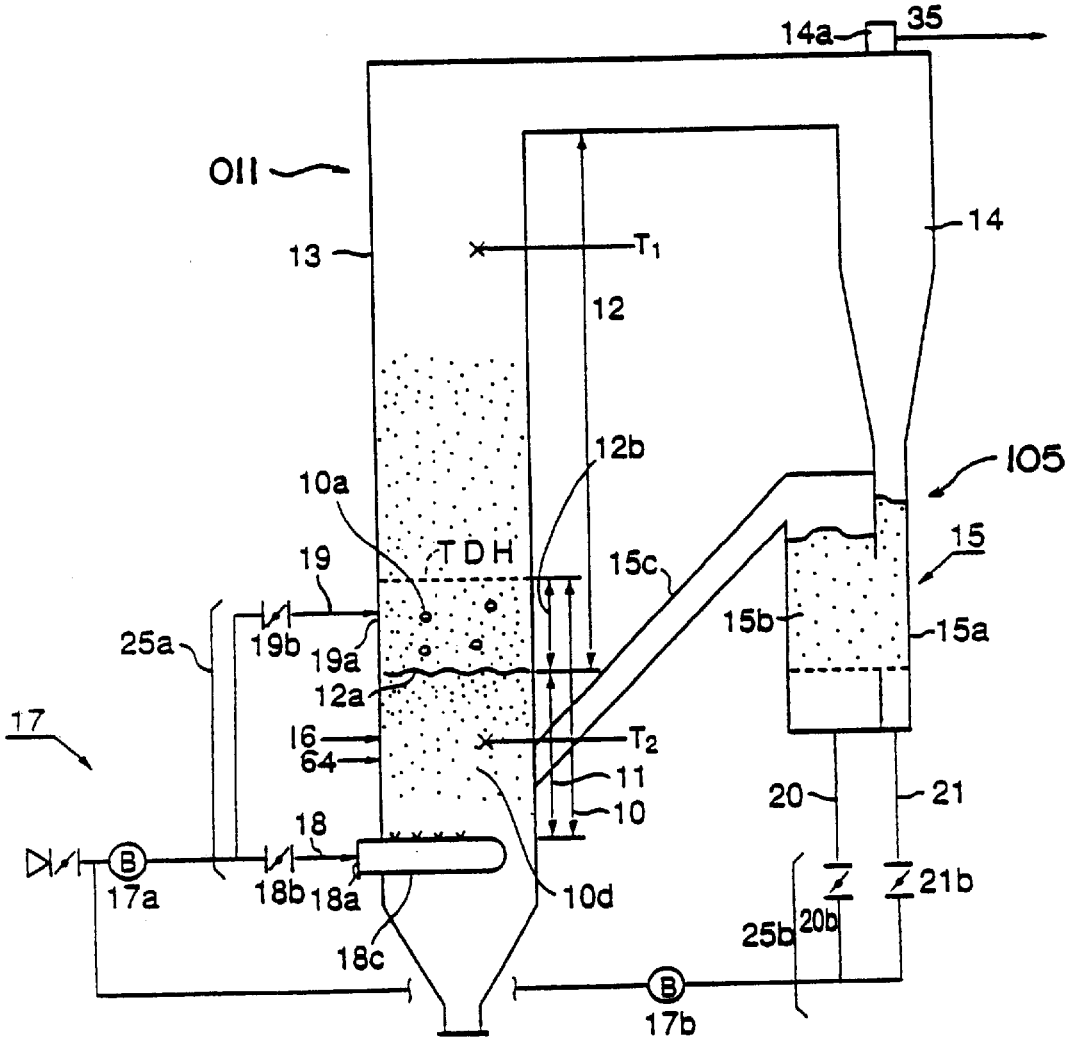
FIG. 16 illustrates the rough sketch of the fluidized bed incinerator according to the fifth preferred embodiment of this invention.
Figure 17:
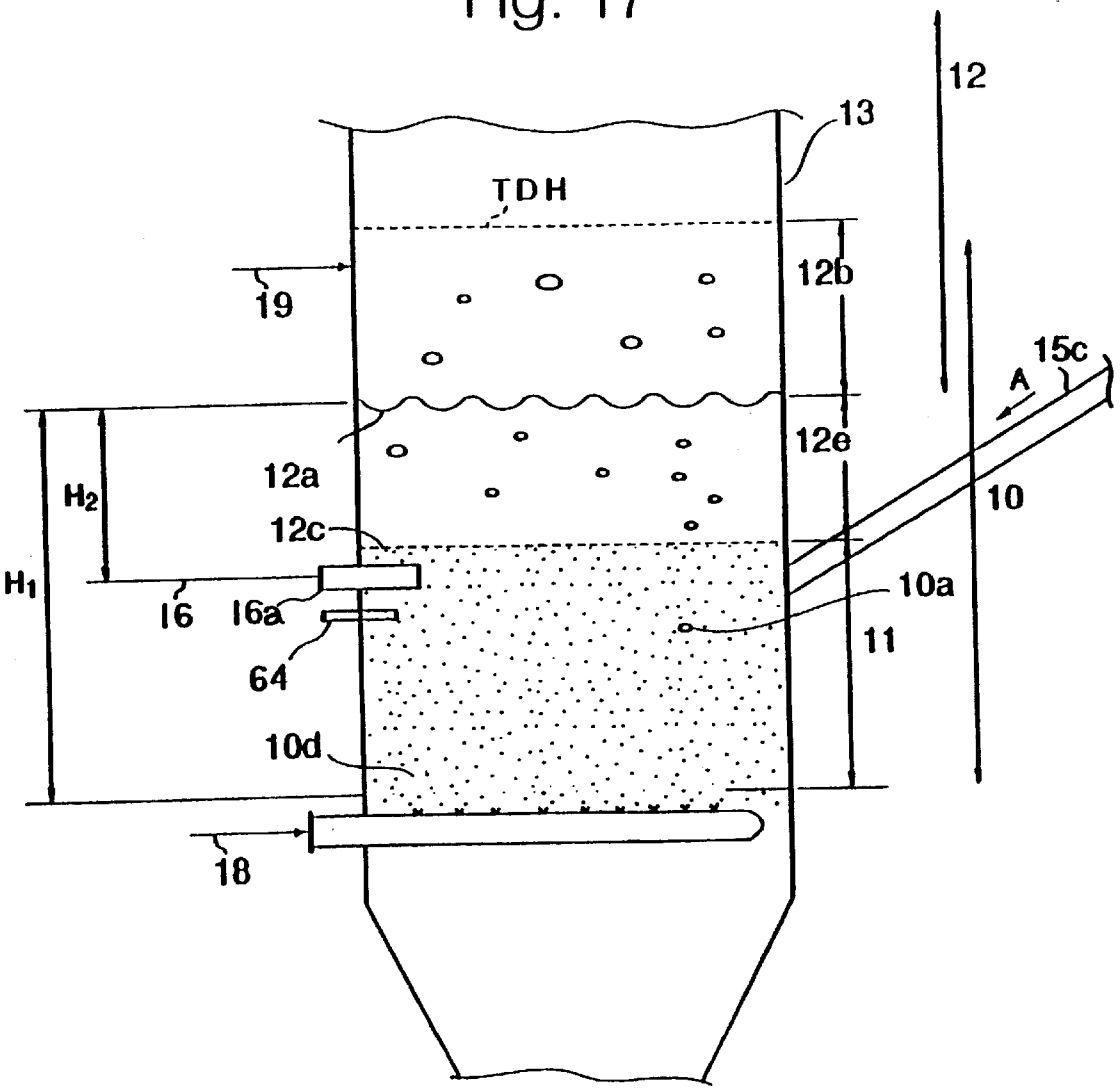
FIG. 17 illustrates the enlarged sketch of the essential portion of the fluidized bed incinerator according to the fifth preferred embodiment of this invention.
Figure 18:
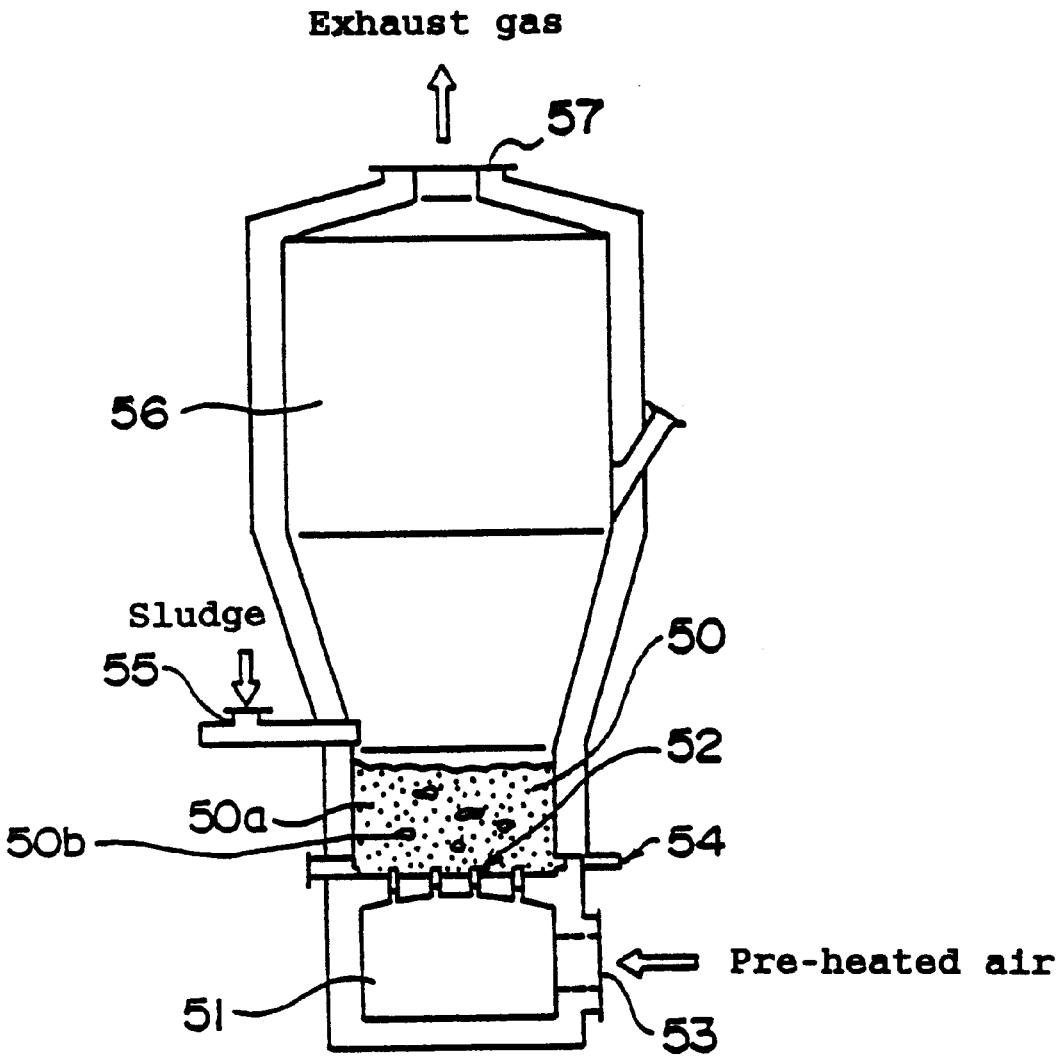
FIG. 18 illustrates the rough sketch of the fluidized bed incinerator according to the prior art.

In FIGS. 16 and 17, 011 is a fluidized bed incinerator which is the fifth preferred embodiment of this invention. It is configured as follows.

The said fluidized bed incinerator 011 has a fluidizing region 10, in which primary air 18 is blown into dense bed 11, which contains a static bed 12*c* consisting of sand 10*d*, silica or some other fluidizing medium, through gas dispersion device 18*c*, which is located on the bottom of the tower, in order to fluidize the medium in the said dense bed 11 and form on top of dense bed 11 a bubbling region 12*e* with a fluidized bed 12*a*. When the bubbles 10*a* in the aforesaid fluidized bed 12*a* burst, the particles of sand are flung upward to form splash zone 12*b*. Bed region 10 consists of splash zone 12*b*; the aforesaid dense bed 11 and bubbling region 12*e*; an entraining area 12, into which secondary air 25 is introduced, to entrain and convey the aforesaid sand 10*d* into the freeboard 13 above it.

The secondary air 19 which is to entrain the particles in the aforesaid splash zone 12*b* is introduced into the furnace and entrains the particles of fluidizing medium which are thrown upward in the said splash zone 12*b*, carrying them through entraining region 12 to freeboard 13.

The said fluidized bed incinerator 011 has an external recirculation unit 105 consisting of separator 14, a cyclone or other device which conveys the aforesaid entrained fluidizing medium out of the furnace and separates it from exhaust gas 35, and sealed pot 15, which recirculates the collected fluidizing medium, by way of duct 15*c*, to dense bed 11 in the aforesaid fluidizing region 10.

It also has a blower 17*a*; a control system 25*a*, which controls the total quantity as well as the ratio of primary air 18 to secondary air 19, through the use of two dampers, 18*b* and 19*b*; and a gas supply system 17, consisting of a blower 17*b*, which sends air into the aforesaid sealed pot 15, and a control system 25*b*.

As can be seen in FIG. 17, there is an inlet 16*a* for waste material which opens into dense bed 11, which forms the base of the aforesaid fluidizing region 10.

Temperature gauges $T_1$ and $T_2$ measure the furnace temperature in the aforesaid freeboard 13 and fluidizing region 10, respectively. Control system 25*a* of gas supply system 17 controls the ratio of primary air 18 to secondary air 19 according to the temperature fluctuations in the furnace.

In control system 25*a*, the air provided by blower 17*a* is adjusted by dampers 18*b* and 19*b* to control both the total quantity of air in the furnace and the ratio of primary to secondary air.

In control system 25*b*, the air provided by blower 17*b* is adjusted by dampers 20*b* and 21*b* and used to fluidize the sand in the sealed pot. This allows the sand to be recirculated from external recirculation unit 105 back to fluidizing region 10.

The primary air 18 whose proportion is controlled by the aforesaid damper 18*b* is blown into the bottom of the furnace through inlet 18*a* and distributed uniformly by distribution device 18*c*. When the air reaches the threshold fluidizing velocity, sand 10*d*, the fluidizing medium comprising dense bed 11 in fluidizing region 10, forms a uniform fluidized bed with a surface 12*a* of fluidized sand. When the air speed in the tower exceeds the bubble fluidization velocity, the interior of the bed is agitated by the bubbles 10*a* which begin to form. A bubbling region 12*e* forms in the aforesaid uniform fluidized bed, causing this region to be non-uniformly fluidized, and forming bubble-fluidized region 10. As the bubbles 10*a* on the aforesaid sand surface 12*a* burst, they cause particles of sand to be thrust upward to form splash zone 12*b*.

Opening or closing damper 18*b* of control system 25*a* in the aforesaid gas supply system 17 increases or decreases the ratio of primary air 18 to secondary air 19. By controlling the temperature of fluidizing region 10 and increasing or decreasing the quantity of particles which pass through freeboard 13, we can control the suspension density in freeboard 13. To be specific, the suspension density is controlled so that it remains between 1.5 $kg/m^3$ and 10 $kg/m^3$.

The secondary air 19 which is decreased or increased by adjusting damper 19*b* in response to the increase or decrease of primary air 18 by the control operation described above entrains and conveys the particles of medium thrown up into splash zone 12*b*. When the appropriate suspension density, specifically, a density between 1.5 $kg/m^3$ and 10 $kg/m^3$, has been achieved with respect to the aforesaid freeboard 13 to compensate for load variation, the aforesaid particles are collected by external recirculation unit 105, which consists of separator 14 and sealed pot 15, in the collection tank of sealed pot 15. The particles which are collected are recirculated, by means of fluidizing air, to dense bed 11 in the aforesaid fluidizing region 10. The combustion heat from freeboard 13 is also recirculated to prevent the combustion temperature in region 10 from slipping so as to maintain stable combustion.

As can be seen in the rough sketch in FIG. 17, the aforesaid inlet 16*a* for waste material is in the upper portion of dense bed 11, which sits on the bottom of bubble-fluidized region 10. When primary air 18 is introduced into the furnace, sand 10*d*, the fluidizing medium comprising dense bed 11, begins to fluidize. When the velocity of primary air 18 is further increased so that it exceeds the threshold for bubble fluidization, numerous bubbles 10*a* form in the aforesaid sand 10*d*, which has begun to fluidize. These bubbles create bubbling region 12*e*, which assumes a boiling state.

In this invention, inlet 16*a* for the waste material is near the border between the top of the aforesaid dense bed 11 and bubbling region 12*e*. This design enables combustion to occur in the deep portion of bubble-fluidized region 10, including dense bed 11, thus guaranteeing stable combustion.

The waste material introduced directly into the vigorously fluidized hot sand bed is pulverized when it experiences the explosive force of momentary volatilization of its moisture component and distributed uniformly throughout the entire bubbling region 12*e* above the bed. Thus even dense bed 11 on the bottom of bed region 10 is used efficiently for combustion. This results in a wider range of permitted loads.

Because the waste material is supplied to a relatively deep portion (i.e., dense bed region 11) of bed region 10, only a small proportion of its volatile component is lost to freeboard 13. The greater portion is combusted in the sand bed, which has a higher thermal capacity. This design allows the furnace to absorb load fluctuations and maintain a stable temperature, resulting in stable operation.

As was discussed above, the waste material which is introduced into the middle of sand 10*d*, in an area which is fluidized at a high temperature and under extreme pressure, experiences the tremendous force produced by instantaneous volatilization of its moisture component. This prevents the formation of clods of melted ash which would impede fluidity.

The height $H_2$ at which waste inlet 16*a* should be placed to best realize the function described above is at a depth at least ⅓ of height $H_1$, the total distance from the fluidized sand surface 12*a* to the bottom of the furnace. Auxiliary burner 64 and the inlet through which the fluidizing medium is returned from the external recirculation unit via duct 15*c* are placed lower than the aforesaid waste inlet 16 so as to prevent the waste material introduced into the furnace from lowering the temperature of the sand bed.

When this sort of furnace operates, the suspension density resulting from the holdup rate of the sand (i.e., the fluidizing medium) in freeboard 13 is preset to range from 1.5 $kg/m^3$ to 10 $kg/m^3$. The average mass flow velocity Gs of the particles (i.e., of the fluidized sand) is set according to the expected temperature drop of the exhaust gas (the temperature of the exhaust gas is between 800 and 1000° C.) when sand is added to the chamber (the specific heat of the sand is 0.2 Kcal/Kg° C.). The values for the height at which secondary air 19 is to be injected and the total quantity of primary air 18 and secondary air 19 are determined, and the quantity of particles to be circulated is established.

The ratio of primary air 18 to secondary air 19 is set between one to two and two to one so that the upper and lower limits of the suspension density fall between 1.5 $kg/m^3$ and 10 $kg/m^3$.

The airflow obtained from blower 17*a* is divided by dampers 18*b* and 19*b* in control system 25*a* into primary air 18 and secondary air 19. The airflow from blower 17*b* is transmitted by control system 25*b* to external recirculation unit 105 to return the fluidizing medium from sealed pot 15 to bed region 10 (more specifically, to dense bed 11).

The control state of the temperature achieved by adjusting the ratio of the aforesaid primary air 18 to secondary air 19 is explained by the time chart in FIG. 12 for the third embodiment.

In the present embodiment, too, the sum of the quantities of primary air 18 and secondary air 19 remains constant, as does the rate of circulation of the fluidizing medium (i.e., the sand).

As can be seen in FIG. 12, when $\Delta T$ ($T_1$–$T_2$), the difference between furnace temperatures $T_1$ and $T_2$, exceeds a given value, control system 25*a* goes into operation and causes damper 18*b* for primary air 18 to open more and damper 19*b* for secondary air 19 to close more. This increases the proportion of primary air 18 in the mixture, and decreases the proportion of secondary air 19, which raises the temperature $T_2$ of bed region 10 and lowers the temperature $T_1$ of freeboard 13.

In contrast, when the aforesaid difference $\Delta T$ ($T_1$–$T_2$) between $T_1$ and $T_2$ falls below a given value, damper 18*b* for primary air 18 is closed more and damper 19*b* for secondary air 19 is opened more. This decreases the proportion of primary air 18 in the mixture, and increases the proportion of secondary air 19, which lowers the temperature $T_2$ of bed region 10 and raises the temperature $T_1$ of freeboard 13.

Controlling the ratio of primary air 18 to secondary air 19 yields the result of controlling the holdup rate and suspension density in bed 10 and freeboard 13, which are in an inverse relationship with each other. This being the case, there is a limit to the range of control which is possible. However, the waste material loaded into the furnace via inlet 16*a*, which feeds into the deep portion of bed region 10 (i.e., into the dense bed), can be combusted throughout the entire fluidized bed, including the sand bed with its high thermal capacity. The furnace can thus respond to a wide range of sudden temperature spikes resulting from fluctuations in the load characteristics.

EFFECTS OF THE INVENTION

As has been disclosed above, with the present invention, when the primary air which fluidizes the sand is blown into the furnace from below what will become the fluidized bed, the sand which is the fluidizing medium is blown upward into the splash zone. This fluidizing medium is then entrained on secondary air introduced into the splash zone and conveyed up into the freeboard. The result is a constant circulation of fluidizing medium through the freeboard. Thus the fluidizing medium, which has a high thermal capacity, is able to absorb fluctuations in the temperature of the freeboard, guaranteeing stable operation.

Furthermore, the fluidizing medium conveyed to the freeboard by the aforesaid secondary air, now very hot from absorbing the combustion heat in the freeboard, is returned via the external recirculation unit to the dense bed in the fluidizing region. This design insures that the temperature of the sand in the said dense bed remains at an appropriate value, and by eliminating the need for more fluidizing air, it increases the upper limit of the load due to moisture content on the floor of the furnace. It also reduces the quantity of fuel needed to maintain the temperature of the sand bed. It reduces the quantity of exhaust gas and insures that the exhaust gas is at the appropriate temperature, and it reduces the required fuel cost.

This design also allows the ratio of a fixed quantity of the aforesaid primary and secondary air to be adjusted. It allows the holdup rate of the fluidizing medium above the level where the secondary air is introduced to be controlled and the suspension density in the freeboard to be adjusted. The thermal capacity of the freeboard can thus be adjusted as needed to respond to fluctuations in the load.

With this invention, the height of the bed surface achieved by expanding the bed with primary air, the fluidizing gas, and the height of the splash zone, which includes the highest point to which sand particles are thrown (12*g* (TDH) in FIG. 1), can be adjusted. The holdup rate of the fluidizing medium entrained by the secondary air above its inlet in the splash zone can be increased or decreased to adjust the suspension density in the freeboard so that it remains between 1.5 $kg/m^3$ and 10 $kg/m^3$.

With this invention, secondary air is brought into the splash zone, a discontinuous space above the surface of the bed in the fluidizing region. The total quantity of primary and secondary air can thus be controlled to insure that a given quantity of fluidizing medium circulate through the freeboard in response to the quality and quantity of waste material loaded in the furnace. This heated medium is returned to the cooler bed region to eliminate the need for auxiliary fuel. It maintains the exhaust gas at the proper temperature.

The ratio of primary to secondary air is controlled by the control unit for that purpose. This allows the thermal capacities of the freeboard and bed region to be controlled in response to load fluctuations.

With the inventions disclosed in certain preferred embodiments, the aforesaid fixed quantity of primary and secondary air is supplied and the holdup rate of the fluidizing medium is controlled from a position above the point at which the secondary air is introduced. The suspension density in the freeboard is controlled so that the thermal capacity of the freeboard can be controlled as needed in response to load fluctuations. In addition to changing the density of the particles entrained in the primary air, we can also change the suspension density in the freeboard by introducing more secondary air through one or more inlets arrayed vertically above the bed region. The closer to the sand surface the secondary air is introduced, the greater the change in the suspension density of the freeboard.

With the inventions disclosed in certain preferred embodiments, the fluidizing medium entrained and conveyed through the freeboard is collected in a sealed pot. When air is blown into this pot, the medium is returned to the dense bed in the fluidizing region. This allows the combustion heat from the freeboard to be recirculated to the dense bed. By increasing the quantity of fluidizing medium in the bed, we can adjust the suspension density in the freeboard. This allows local and momentary temperature spikes in the freeboard which result from load fluctuations to be absorbed more reliably.

With the inventions disclosed in certain preferred embodiments, the fluidizing medium is supplied to the furnace by a recirculation unit which stores the medium discharged via the outlet on the bottom of the fluidized bed in a buffer tank and circulates it to the furnace in response to the state of the load in order to adjust the suspension density in the freeboard. Thus, a quantity of fluidizing medium which is appropriate for the state of combustion in the freeboard can be loaded into the combustion chamber (i.e., the freeboard) of the furnace. The holdup rate in the freeboard can be increased or decreased to adjust the suspension density. This design allows the system to respond to a wide range of load fluctuations.

With the inventions disclosed in certain preferred embodiments, the instantaneous volatilization of the moisture component of the waste material loaded in the furnace produces a tremendous force which prevents the formation of clods of melted ash. The pulverized waste material which results is distributed uniformly throughout the bubbling region, including the dense bed, thus insuring complete combustion in the deep portion of the bubbling region.

What is claimed is:

1. An operating method to operate a fluidized bed incinerator, comprising a step of:

injecting primary air for fluidizing a fluidizing medium from a bottom of a fluidizing region;

injecting secondary air into a splash region in which bubbles on the surface of the fluidizing medium burst and particles are propelling upward when the bubbles are burst;

entraining and conveying upward the fluidizing medium out of said incinerator via a freeboard;

recirculating the fluidizing medium to the fluidizing region; and controlling a thermal capacity of the freeboard, and a temperature of the fluidizing medium to be constant by controlling a ratio of the primary and secondary air.

2. An operating method to operate a fluidized bed incinerator according to claim 1, wherein said controlling step controls the suspension density in the freeboard and the volume of recirculated fluidizing medium by controlling the of the primary and secondary air.

3. An operating method to operate a fluidized bed incinerator according to claim 1, wherein the suspension density in the freeboard is kept between 1.5 $kg/m^3$ and 10 $kg/m^3$.

4. An operating method to operate a fluidized bed incinerator according to claim 1, further comprising a step of recirculating the fluidizing medium via an external recirculation unit out of the fluidized bed incinerator.

5. An operating method to operate a fluidized bed incinerator, comprising the step of:

injecting primary air for fluidizing a fluidizing medium from a bottom of a fluidizing region;

injecting secondary air for fluidizing a region in which bubbles on the surface of fluidized sand burst and particles are propelling upward when the bubbles are burst, said secondary air being injected selectively from one or more air inlets;

entraining and conveying upward the fluidizing medium out of said incinerator via a freeboard; and controlling the suspension density in the freeboard by selecting the air inlets for adjusting the height of said injecting the second air, wherein said controlling step controls the suspension density in the freeboard and the volume of recirculated fluidizing medium by controlling the ratio of the primary and secondary air.

6. An operating method to operate a fluidized bed incinerator, comprising the step of:

injecting primary air for fluidizing a fluidizing medium from a bottom of a fluidizing region;

injecting secondary air for fluidizing a region in which bubbles on the surface of fluidized sand burst and particles are propelled upward when the bubbles are burst, said secondary air being injected selectively from one or more air inlets;

entraining and conveying upward the fluidizing medium out of said incinerator via a freeboard; and controlling the suspension density in the freeboard by selecting the air inlets for adjusting the height of said injecting the second air, wherein the suspension density in the freeboard is kept between 1.5 $kg/m^3$ and 10 $kg/m^3$.

7. A fluidized bed incinerator having a splash region in which particles of a fluidizing medium including fluidized sand are propelled upward when bubbles on the surface of the fluidized sand in a fluidizing region burst by injecting primary air from the bottom of the fluidized bed for fluidizing the sand, and a freeboard region provided above the splash region, comprising:

an entraining region in which the particles are entrained and conveyed upward to the freeboard region by a secondary air introducer in the splash region which introduces secondary air into the splash region; and a secondary air controller provided with an air supplying unit to supply the secondary air from one of a plurality of air inlets which are provided in the splash region vertically, said secondary air controller controlling opening and closing of said air supplying unit, wherein said secondary air controller controls the opening and closing of the plurality of air inlets based on the temperature difference between the freeboard region and the fluidizing region.

8. A fluidized bed incinerator, comprising:

a splash region in which particles of a fluidizing medium including fluidized sand are propelled upward when bubbles on the surface of the fluidized sand in a fluidizing region burst by injecting primary air from the bottom of the fluidized bed for fluidizing the sand;

a freeboard region provided above the splash region;

an entraining region in which the particles are entrained and conveyed upward to the freeboard region by introducing secondary air;

a recirculation unit to separate the particles of the fluidizing medium from a mixture of exhaust gases and the fluidizing medium and recirculate the fluidizing medium to the fluidizing region;

a buffer tank to store the fluidizing medium discharged from an outlet along with uncombusted material, which is provided below the fluidizing region; and a buffer tank controller to control supplying the fluidizing medium to the fluidizing region based on a temperature in said freeboard region depending on a load fluctuation in said fluidized bed incinerator.

* * * * *